US010026411B2

(12) United States Patent
Vos

(10) Patent No.: US 10,026,411 B2
(45) Date of Patent: Jul. 17, 2018

(54) SPEECH ENCODING UTILIZING INDEPENDENT MANIPULATION OF SIGNAL AND NOISE SPECTRUM

(71) Applicant: Skype, Dublin (IE)

(72) Inventor: Koen Bernard Vos, San Francisco, CA (US)

(73) Assignee: SKYPE, Dublin (IE)

( * ) Notice: Subject to any disclaimer, the term of this patent is extended or adjusted under 35 U.S.C. 154(b) by 0 days.

(21) Appl. No.: 14/459,984

(22) Filed: Aug. 14, 2014

(65) Prior Publication Data

US 2014/0358531 A1 Dec. 4, 2014

Related U.S. Application Data

(63) Continuation of application No. 14/162,707, filed on Jan. 23, 2014, now Pat. No. 8,849,658, which is a (Continued)

(30) Foreign Application Priority Data

Jan. 6, 2009 (GB) ..... 0900143.9

(51) Int. Cl.
*G10L 19/04* (2013.01)
*G10L 19/087* (2013.01)
(Continued)

(52) U.S. Cl.
CPC ..... *G10L 19/087* (2013.01); *G10L 19/00* (2013.01); *G10L 19/04* (2013.01); *G10L 19/26* (2013.01)

(58) Field of Classification Search
CPC ..... G10L 19/04; G10L 19/06; G10L 19/07; G10L 19/08; G10L 19/09; G10L 19/22; G10L 19/26
(Continued)

(56) References Cited

U.S. PATENT DOCUMENTS 4,605,961 A 8/1986 Frederiksen
4,850,022 A 7/1989 Honda et al.
(Continued)

FOREIGN PATENT DOCUMENTS

CN 1255226 5/2000
CN 1337042 2/2002
(Continued)

OTHER PUBLICATIONS

"Coding of Speech at 8 kbit/s Using Conjugate-Structure Algebraic-Code-Excited Linear-Prediction (CS-ACELP)", International Telecommunication Union, ITUT, 1996, 39 pages.
(Continued)

*Primary Examiner* — Michael N Opsasnick
(74) *Attorney, Agent, or Firm* — Schwegman Lundberg & Woessner, P.A.

(57) ABSTRACT

Some embodiments describe methods, programs, and systems for speech encoding. Among other things, a received input signal representing a property of speech is quantized to generate a quantized output signal. Prior to the quantization, a version of the input signal is supplied to a first noise shaping filter having a first set of filter coefficients effective to generate a first filtered signal. Following the quantization, the quantized output signal is supplied to a second noise shaping filter having a second set of filter coefficients, thus generating a second filtered signal. A noise shaping operation is performed to control a frequency spectrum of a noise effect in the quantized output signal caused by the quantization, wherein the noise shaping operation is based on both the first and second filtered signals. Finally, the quantized output signal is transmitted in an encoded signal.

22 Claims, 11 Drawing Sheets

Related U.S. Application Data continuation of application No. 13/905,864, filed on May 30, 2013, now Pat. No. 8,639,504, which is a continuation of application No. 12/455,100, filed on May 28, 2009, now Pat. No. 8,463,604.

(51) Int. Cl.
*G10L 19/00* (2013.01)
*G10L 19/26* (2013.01)

(58) Field of Classification Search
USPC ..... 704/229, 230
See application file for complete search history.

(56) References Cited

U.S. PATENT DOCUMENTS 4,857,927 A 8/1989 Takabayashi
4,916,449 A 4/1990 Kubo et al.
4,922,537 A 5/1990 Frederiksen
5,125,030 A 6/1992 Nomura et al.
5,240,386 A 8/1993 Amin et al.
5,253,269 A 10/1993 Gerson et al.
5,327,250 A 7/1994 Ikeda
5,357,252 A 10/1994 Ledzius et al.
5,487,086 A 1/1996 Bhaskar
5,548,680 A 8/1996 Cellario
5,646,961 A * 7/1997 Shoham et al. ..... 375/243
5,649,054 A 7/1997 Oomen et al.
5,680,508 A 10/1997 Liu
5,699,382 A * 12/1997 Shoham et al. ..... 375/243
5,774,842 A 6/1998 Nishio et al.
5,867,814 A 2/1999 Yong
5,950,155 A 9/1999 Nishiguchi
6,104,992 A 8/2000 Gao et al.
6,122,608 A 9/2000 McCree
6,173,257 B1 1/2001 Gao
6,188,980 B1 2/2001 Thyssen
6,260,010 B1 7/2001 Gao et al.
6,363,119 B1 3/2002 Oami
6,408,268 B1 6/2002 Tasaki
6,456,964 B2 9/2002 Manjunath et al.
6,470,309 B1 10/2002 McCree
6,493,665 B1 12/2002 Su et al.
6,502,069 B1 12/2002 Grill et al.
6,523,002 B1 2/2003 Gao et al.
6,574,593 B1 6/2003 Gao et al.
6,664,913 B1 12/2003 Craven et al.
6,751,587 B2 6/2004 Thyssen et al.
6,757,649 B1 6/2004 Gao et al.
6,757,654 B1 6/2004 Westerlund et al.
6,775,649 B1 8/2004 DeMartin
6,862,567 B1 3/2005 Gao
6,996,523 B1 2/2006 Bhaskar et al.
7,136,812 B2 11/2006 Manjunath et al.
7,143,032 B2 11/2006 Chen
7,149,683 B2 12/2006 Jelinek
7,151,802 B1 12/2006 Bessette et al.
7,171,355 B1 1/2007 Chen
7,252,803 B2 * 8/2007 Guthrie et al. ..... 159/6.1
7,496,505 B2 2/2009 Manjunath et al.
7,505,594 B2 3/2009 Mauro
7,684,981 B2 3/2010 Thumpudi et al.
7,778,476 B2 8/2010 Alvarez et al.
7,869,993 B2 1/2011 Ojala
7,873,511 B2 * 1/2011 Herre et al. ..... 704/205
8,036,887 B2 10/2011 Yasunaga et al.
8,069,040 B2 * 11/2011 Vos ..... 704/222
8,078,474 B2 * 12/2011 Vos et al. ..... 704/500
8,140,324 B2 * 3/2012 Vos et al. ..... 704/225
8,244,526 B2 * 8/2012 Vos et al. ..... 704/226
8,392,178 B2 3/2013 Vos
8,396,706 B2 3/2013 Vos
8,433,563 B2 4/2013 Vos
8,452,606 B2 5/2013 Vos
8,463,604 B2 6/2013 Vos
8,639,504 B2 1/2014 Vos
8,655,653 B2 2/2014 Vos
8,670,981 B2 3/2014 Vos et al.
8,682,652 B2 * 3/2014 Herre et al. ..... 704/200.1
8,849,658 B2 9/2014 Vos
9,263,051 B2 2/2016 Vos
9,530,423 B2 12/2016 Vos
2001/0001320 A1 5/2001 Heinen et al.
2001/0005822 A1 6/2001 Fujii et al.
2001/0039491 A1 11/2001 Yasunaga et al.
2002/0032571 A1 3/2002 Leung et al.
2002/0049586 A1 4/2002 Nishio et al.
2002/0099540 A1 7/2002 Yasunaga et al.
2002/0120438 A1 8/2002 Lin
2002/0156625 A1 10/2002 Thyssen
2003/0135367 A1 7/2003 Thyssen et al.
2003/0200092 A1 10/2003 Gao et al.
2004/0102969 A1 5/2004 Manjunath et al.
2005/0007262 A1 1/2005 Craven et al.
2005/0141721 A1 6/2005 Aarts et al.
2005/0278169 A1 12/2005 Hardwick
2005/0285765 A1 12/2005 Suzuki et al.
2006/0074643 A1 4/2006 Lee et al.
2006/0235682 A1 10/2006 Yasunaga et al.
2006/0265216 A1 11/2006 Chen
2006/0271356 A1 11/2006 Vos
2006/0277039 A1 12/2006 Vos et al.
2006/0282262 A1 12/2006 Vos et al.
2007/0043560 A1 2/2007 Lee
2007/0055503 A1 3/2007 Chu et al.
2007/0064956 A1 3/2007 Iwata
2007/0088543 A1 4/2007 Ehara
2007/0100613 A1 5/2007 Yasunaga et al.
2007/0136057 A1 6/2007 Phillips
2007/0225971 A1 9/2007 Bessette
2007/0255561 A1 11/2007 Su et al.
2008/0004869 A1 1/2008 Herre et al.
2008/0015866 A1 1/2008 Thyssen et al.
2008/0091418 A1 4/2008 Laaksonen et al.
2008/0126084 A1 5/2008 Lee et al.
2008/0140426 A1 6/2008 Kim et al.
2008/0154588 A1 6/2008 Gao
2008/0275698 A1 11/2008 Yasunaga et al.
2009/0012781 A1 1/2009 Yasunaga et al.
2009/0043574 A1 2/2009 Gao et al.
2009/0222273 A1 9/2009 Massaloux et al.
2010/0174531 A1 7/2010 Vos
2010/0174532 A1 7/2010 Vos et al.
2010/0174534 A1 7/2010 Vos
2010/0174541 A1 7/2010 Vos
2010/0174542 A1 7/2010 Vos
2010/0174547 A1 7/2010 Vos
2011/0077940 A1 3/2011 Vos et al.
2011/0173004 A1 7/2011 Bessette et al.
2013/0262100 A1 10/2013 Vos
2014/0142936 A1 5/2014 Vos
2014/0163973 A1 6/2014 Vos
2014/0358531 A1 12/2014 Vos

FOREIGN PATENT DOCUMENTS

CN 1653521 8/2005
EP 0501421 9/1992
EP 0550990 7/1993
EP 0610906 8/1994
EP 0720145 7/1996
EP 0724252 7/1996
EP 0849724 6/1998
EP 0877355 11/1998
EP 0957472 11/1999
EP 1093116 4/2001
EP 1255244 11/2002
EP 1326235 7/2003
EP 1758101 2/2007
EP 1903558 3/2008
GB 2466669 7/2010
GB 2466670 7/2010
GB 2466671 7/2010
GB 2466672 7/2010

(56) References Cited

FOREIGN PATENT DOCUMENTS

| | | |
|---|---|---|
| GB | 2466673 | 7/2010 |
| GB | 2466674 | 7/2010 |
| GB | 2466675 | 7/2010 |
| JP | 1205638 | 10/1987 |
| JP | 2287400 | 4/1989 |
| JP | 4312000 | 4/1991 |
| JP | 7306699 | 5/1994 |
| JP | 2007279754 | 10/2007 |
| WO | WO-9103790 | 3/1991 |
| WO | WO-9403988 | 2/1994 |
| WO | WO-9518523 | 7/1995 |
| WO | WO-9918565 | 4/1999 |
| WO | WO-9963521 | 12/1999 |
| WO | WO-0103122 | 1/2001 |
| WO | WO-0191112 | 11/2001 |
| WO | WO-03052744 | 6/2003 |
| WO | WO-2005009019 | 1/2005 |
| WO | WO-2008046492 | 4/2008 |
| WO | WO-2008056775 | 5/2008 |
| WO | WO-2010079163 | 7/2010 |
| WO | WO-2010079164 | 7/2010 |
| WO | WO-2010079165 | 7/2010 |
| WO | WO-2010079166 | 7/2010 |
| WO | WO-2010079167 | 7/2010 |
| WO | WO-2010079170 | 7/2010 |
| WO | WO-2010079171 | 7/2010 |

OTHER PUBLICATIONS

"Corrected Notice of Allowance", U.S. Appl. No. 14/162,707, dated Sep. 3, 2014, 5 pages.
"Examination Report", GB Application No. 0900143.9, dated May 21, 2012, 2 pages.
"Examination Report", GB Application No. 0900139.7, dated Aug. 28, 2012, 1 page.
"Examination Report", GB Application No. 0900140.5, dated Aug. 29, 2012, 3 pages.
"Examination Report", GB Application No. 0900141.3, dated Oct. 8, 2012, 2 pages.
"Final Office Action", U.S. Appl. No. 12/455,100, dated Oct. 4, 2012, 5 pages.
"Final Office Action", U.S. Appl. No. 12/455,478, dated Jun. 29, 2012, 8 pages.
"Final Office Action", U.S. Appl. No. 12/455,632, dated Jan. 18, 2013, 15 pages.
"Final Office Action", U.S. Appl. No. 12/455,752, dated Nov. 23, 2012, 8 pages.
"Final Office Action", U.S. Appl. No. 12/583,998, dated May 20, 2013, 19 pages.
"Foreign Notice of Allowance", CN Application No. 201080010209.6, dated Apr. 1, 2014, 3 pages.
"Foreign Notice of Allowance", EP Application No. 10700158.8, dated Jun. 3, 2014, 7 pages.
"Foreign Office Action", CN Application No. 201080010208.1, dated Dec. 28, 2012, 12 pages.
"Foreign Office Action", CN Application No. 201080010209, dated Jan. 30, 2013, 12 pages.
"Foreign Office Action", EP Application No. 10700158.8, dated Oct. 15, 2013, 4 pages.
"Foreign Office Action", GB Application No. 0900145.4, dated May 28, 2012, 2 pages.
"International Search Report and Written Opinion", Application No. PCT/EP2010/050057, dated Jun. 24, 2010, 11 pages.
"International Search Report and Written Opinion", Application No. PCT/EP2010/050051, dated Mar. 15, 2010, 13 pages.
"International Search Report and Written Opinion", Application No. PCT/EP2010/050061, dated Apr. 12, 2010, 13 pages.
"International Search Report and Written Opinion", Application No. PCT/EP2010/050052, dated Jun. 21, 2010, 13 pages.
"International Search Report and Written Opinion", Application No. PCT/EP2010/050060, dated Apr. 14, 2010, 14 pages.
"International Search Report and Written Opinion", Application No. PCT/EP2010/050053, dated May 17, 2010, 17 pages.
"International Search Report and Written Opinion", Application No. PCT/EP2010/050056, dated Mar. 29, 2010, 8 pages.
"Non-Final Office Action", U.S. Appl. No. 12/455,100, dated Jun. 8, 2012, 8 pages.
"Non-Final Office Action", U.S. Appl. No. 12/455,157, dated Aug. 6, 2012, 15 pages.
"Non-Final Office Action", U.S. Appl. No. 12/455,632, dated Jun. 4, 2013, 13 pages.
"Non-Final Office Action", U.S. Appl. No. 12/455,632, dated Oct. 18, 2011, 14 pages.
"Non-Final Office Action", U.S. Appl. No. 12/455,632, dated Feb. 6, 2012, 18 pages.
"Non-Final Office Action", U.S. Appl. No. 12/455,632, dated Aug. 22, 2012, 14 pages.
"Non-Final Office Action", U.S. Appl. No. 12/455,712, dated Jun. 20, 2012, 8 pages.
"Non-Final Office Action", U.S. Appl. No. 12/455,752, dated Jun. 15, 2012, 8 pages.
"Non-Final Office Action", U.S. Appl. No. 12/583,998, dated Oct. 18, 2012, 16 pages.
"Non-Final Office Action", U.S. Appl. No. 12/586,915, dated May 8, 2012, 10 pages.
"Non-Final Office Action", U.S. Appl. No. 12/586,915, dated Sep. 25, 2012, 10 pages.
"Non-Final Office Action", U.S. Appl. No. 13/905,864, dated Aug. 15, 2013, 6 pages.
"Notice of Allowance", U.S. Appl. No. 12/455,100, dated Feb. 5, 2013, 4 Pages.
"Notice of Allowance", U.S. Appl. No. 12/455,157, dated Nov. 29, 2012, 9 pages.
"Notice of Allowance", U.S. Appl. No. 12/455,478, dated Dec. 7, 2012, 7 pages.
"Notice of Allowance", U.S. Appl. No. 12/455,632, dated Oct. 9, 2013, 8 pages.
"Notice of Allowance", U.S. Appl. No. 12/455,632, dated May 15, 2012, 7 pages.
"Notice of Allowance", U.S. Appl. No. 12/455,712, dated Oct. 23, 2012, 7 pages.
"Notice of Allowance", U.S. Appl. No. 12/455,752, dated Oct. 4, 2013, 6 pages.
"Notice of Allowance", U.S. Appl. No. 12/586,915, dated Jan. 22, 2013, 8 pages.
"Notice of Allowance", U.S. Appl. No. 13/905,864, dated Sep. 17, 2013, 5 pages.
"Notice of Allowance", U.S. Appl. No. 14/162,707, dated May 9, 2014, 6 pages.
"Search Report", GB Application No. 0900139.7, dated Apr. 17, 2009, 3 pages.
"Search Report", GB Application No. 0900141.3, dated Apr. 30, 2009, 3 pages.
"Search Report", GB Application No. 0900142.1, dated Apr. 21, 2009, 2 pages.
"Search Report", GB Application No. 0900144.7, dated Apr. 24, 2009, 2 pages.
"Search Report", GB Application No. 0900143.9, dated Apr. 28, 2009, 1 page.
"Search Report", GB Application No. 0900145.4, dated Apr. 27, 2009, 1 page.
"Search Report", GB Application No. 0900140.5, dated May 5, 2009, 3 pages.
"Supplemental Notice of Allowance", U.S. Appl. No. 12/455,100, dated Apr. 4, 2013, 2 pages.
"Supplemental Notice of Allowance", U.S. Appl. No. 12/455,100, dated May 16, 2013, 2 pages.
"Supplemental Notice of Allowance", U.S. Appl. No. 12/455,157, dated Jan. 22, 2013, 2 pages.
"Supplemental Notice of Allowance", U.S. Appl. No. 12/455,157, dated Feb. 8, 2013, 2 pages.

(56) References Cited

OTHER PUBLICATIONS

"Supplemental Notice of Allowance", U.S. Appl. No. 12/455,478, dated Jan. 11, 2013, 2 pages.
"Supplemental Notice of Allowance", U.S. Appl. No. 12/455,478, dated Mar. 28, 2013, 3 pages.
"Supplemental Notice of Allowance", U.S. Appl. No. 12/455,632, dated Jan. 22, 2014, 4 pages.
"Supplemental Notice of Allowance", U.S. Appl. No. 12/455,712, dated Jan. 14, 2013, 2 pages.
"Supplemental Notice of Allowance", U.S. Appl. No. 12/455,712, dated Feb. 5, 2013, 2 pages.
"Supplemental Notice of Allowance", U.S. Appl. No. 12/455,712, dated Dec. 19, 2012, 2 pages.
"Supplemental Notice of Allowance", U.S. Appl. No. 12/455,752, dated Jan. 30, 2014, 2 pages.
"Supplemental Notice of Allowance", U.S. Appl. No. 12/455,752, dated Dec. 16, 2013, 2 pages.
"Supplemental Notice of Allowance", U.S. Appl. No. 13/905,864, dated Jan. 3, 2014, 2 pages.
"Wideband Coding of Speech at Around 1 kbit/sUsing Adaptive Multi-rate Wideband (AMR-WB)", International Telecommunication Union G.722.2, 2002, pp. 1-65.
Atal, et al., "Predictive Coding of Speech Signals and Error Criteria", IEEE, Transactions on Acoustics, Speech and Signal Processing, ASSP 27(3), 1979, pp. 247-254.
"Novel Codec Structures for Noise Feedback Coding of Speech", IEEE, 2006, pp. 681-684.
Chen, "Subframe Interpolation Optimized Coding of LSF Parameters", IEEE, Jul. 2007, pp. 725-728.
Denckla, "Subtractive Dither for Internet Audio", Journal of the Audio Engineering Society, vol. 46, Issue 7/8, Jul. 1998, pp. 654-656.
Ferreira, et al., "Modified Interpolation of LSFs Based on Optimization of Distortion Measures", IEEE, Sep. 2006, pp. 777-782.
Gerzon, et al., "A High-Rate Buried-Data Channel for Audio CD", Journal of Audio Engineering Society, vol. 43, No. 1/2,Jan. 1995, 22 pages.
Haagen, et al., "Improvements in 2.4 KBPS High-Quality Speech Coding", IEEE, Mar. 1992, pp. 145-148.
Islam, et al., "Partial-Energy Weighted Interpolation of Linear Prediction Coefficients", IEEE, Sep. 2000, pp. 105-107.
Jayant, et al., "The Application of Dither to the Quantization of Speech Signals", Program of the 84th Meeting of the Acoustical Society of America. (Abstract Only), Nov.-Dec. 1972, pp. 1293-1304.
Lupini, et al., "A Multi-Mode Variable Rate Celp Coder Based on Frame Classification", Proceedings of the International Conference on Communications (ICC), IEEE 1, 1993, pp. 406-409.
Mahe, et al., "Quantization Noise Spectral Shaping in Instantaneous Coding of Spectrally Unbalanced Speech Signals", IEEE, Speech Coding Workshop, 2002, pp. 56-58.
Makhoul, et al., "Adaptive Noise Spectral Shaping and Entropy Coding of Speech", Feb. 1979, pp. 63-73.
Martins et al., "Interpolation-Based Differential Vector Coding of Speech LSF Parameters", IEEE, Nov. 1996, pp. 2049-2052.
Rao, et al., "Pitch Adaptive Windows for Improved Excitation Coding in Low-Rate CELP Coders", IEEE Transactions on Speech and Audio Processing, Nov. 2003, pp. 648-659.
Salami, "Design and Description of CS-ACELP: A Toll Quality 8 kb/s Speech Coder", IEEE, 6(2), Mar. 1998, pp. 116-130.
"Foreign Notice of Allowance", EP Application No. 10700157.0, dated Oct. 17, 2014, 6 pages.
"Foreign Office Action", EP Application No. 10700157.0, dated Oct. 15, 2013, 5 pages.
"Non-Final Office Action", U.S. Appl. No. 12/583,998, dated Nov. 10, 2014, 20 pages.
"Non-Final Office Action", U.S. Appl. No. 14/182,196, dated Nov. 25, 2014, 18 pages.
"Summons to Attend Oral Proceedings", EP Application No. 10700157.0, May 30, 2014, 6 pages.
"Final Office Action", U.S. Appl. No. 12/583,998, dated May 28, 2015, 19 pages.
"Final Office Action", U.S. Appl. No. 14/182,196, dated Mar. 3, 2015, 25 pages.
"Supplemental Notice of Allowance", U.S. Appl. No. 14/182,196, dated Jan. 14, 2016, 4 pages.
"Notice of Allowance", U.S. Appl. No. 14/182,196, dated Oct. 14, 2015, 7 pages.
"Notice of Allowance", U.S. Appl. No. 12/583,998, dated Sep. 14, 2016, 13 pages.
"Non-Final Office Action", U.S. Appl. No. 12/583,998, dated Jul. 1, 2016, 22 pages.
"Foreign Office Action", EP Application No. 10700159.6, dated Dec. 16, 2016, 7 pages.

* cited by examiner

SPEECH ENCODING UTILIZING INDEPENDENT MANIPULATION OF SIGNAL AND NOISE SPECTRUM

RELATED APPLICATIONS

This application is a continuation of, and claims priority to, U.S. Pat. No. 8,849,658 filed Jan. 23, 2014, which is a continuation of, and claims priority to, U.S. Pat. No. 8,639,504 filed May 30, 2013, which is a continuation of, and claims priority to, U.S. Pat. No. 8,463,604 filed May 28, 2009. U.S. Pat. No. 8,463,604 additionally claims priority under 35 USC 119 or 365 to Great Britain Application No. 0900143.9 filed Jan. 6, 2009, the disclosure of which is incorporated by reference herein in its entirety.

BACKGROUND

In speech coding, it is typically necessary to quantize a signal representing some property of the speech. Quantization is the process of converting a continuous range of values into a set of discrete values; or more realistically in the case of a digital system, converting a larger set of approximately-continuous discrete values into a smaller set of more substantially discrete values. The quantized discrete values are typically selected from predetermined representation levels. Types of quantization include scalar quantization, trellis quantization, lattice quantization, vector quantization, algebraic codebook quantization, and others. The quantization has the effect that the quantized version of the signal requires fewer bits per unit time, and therefore takes less signalling overhead to transmit or less storage space to store.

However, quantization is also a form of distortion of the signal, which may be perceived by an end listener as a kind of noise, sometimes referred to as coding noise. To help alleviate this problem, a noise shaping quantizer may be used to quantize the signal. The idea behind a noise shaping quantizer is to quantize the signal in a manner that weights or biases the noise effect created by the quantization into less noticeable parts of the frequency spectrum, e.g. where the human ear is more tolerant to noise, and/or where the speech energy is high such that the relative effect of the noise is less. That is, noise shaping is a technique to produce a quantized signal with a spectrally shaped coding noise. The coding noise may be defined quantitatively as the difference between input and output signals of the overall quantizing system, i.e. of the whole codec, and this typically has a spectral shape (whereas the quantization error usually refers to the difference between the immediate inputs and outputs of the actual quantization unit, which is typically spectrally flat).

FIG. 1*a* is a schematic block diagram showing one example of a noise shaping quantizer 11, which receives an input signal x(n) and produces a quantized output signal y(n). The noise shaping quantizer 11 comprises a quantization unit 13, a noise shaping filter 15, an addition stage 17 and a subtraction stage 19. The subtraction stage 19 calculates an error signal in the form of the coding noise q(n) by taking the difference between the quantized output signal y(n) and the input to the quantization unit 13, where n is the sample number. The coding noise q(n) is supplied to the noise shaping filter 15 where it is filtered to produce a filtered output. The addition stage 17 then adds this filtered output to the input signal x(n) and supplies the resulting signal to the input of the quantization unit 13.

The input, output and error signals are represented in FIG. 1*a* in the time domain as functions of time x(n), y(n) and q(n) respectively (with time being measured in number of samples n). As will be familiar to a person skilled in the art, the same signals can also be represented in the frequency domain as functions of frequency X(z), Y(z), and Q(z) respectively (z representing frequency). In that case, the noise shaping filter can be represented by a function F(z) in the frequency domain, such that the quantized output signal can be described in the frequency domain as:

$$Y(z)=X(z)+(1+F(z))\cdot Q(z)$$

The quantization error Q(z) typically has a spectrum that is approximately white (i.e. approximately constant energy across its frequency spectrum). Therefore the coding noise has a spectrum approximately proportional to 1+F(z).

Another example of a noise shaping quantizer 21 is shown schematically in FIG. 1*b*. The noise shaping quantizer 21 comprises a quantization unit 23, a noise shaping filter 25, an addition stage 27 and a subtraction stage 29. Similarly to FIG. 1*a*, an error signal in the form of the coding noise q(n) is supplied to the noise shaping filter 25 where it is filtered to produce a filtered output, and the addition stage 27 then adds this filtered output to the input signal x(n) and supplies the resulting signal to the input of the quantization unit 13. However, unlike FIG. 1*a*, the subtraction stage 29 of FIG. 1*b* calculates the error q(n) as the coding noise signal, defined as the difference between the quantized output signal y(n) and the input signal x(n), i.e. the input signal before the filter output is added rather than the immediate input to the quantization unit 23. In this case, the quantized output signal y(n) can be described in the frequency domain as:

$$Y(z) = X(z) + \frac{Q(z)}{1 - F(z)}.$$

Therefore the coding noise has a spectrum proportional to (1−F(z))−1.

Another example is shown in FIG. 1*c*, which is a schematic block diagram of an analysis-by-synthesis quantizer 31. Analysis-by-synthesis is a method in speech coding whereby a quantizer codebook is searched to minimize a weighted coding error signal (the codebook defines the possible representation levels for the quantization). This works by trying representing samples of the input signal according to a plurality of different possible representation levels in the codebook, and selecting the levels which produce the least energy in the weighted coding error signal. The weighting is to bias the coding error towards less noticeable parts of the frequency spectrum.

Referring to FIG. 1*c*, the analysis-by-synthesis quantizer 31 receives an input signal x(n) and produces a quantized output signal y(n). It comprises a controllable quantization unit 33, a weighting filter 35, an energy minimization block 37, and a subtraction stage 39. The quantization unit 33 generates a plurality of possible versions of a portion of the quantized output signal y(n). For each possible version, the subtraction stage 39 subtracts the quantized output y(n) from the input signal x(n) to produce an error signal, which is supplied to the weighting filter 35. The weighting filter 35 filters the error signal to produce a weighted error signal, and supplies this filtered output to the energy minimization block 37. The energy minimization block 37 determines the energy in the weighted error signal for each possible version of the quantized output signal y(n), and selects the version resulting in the least energy in the weighted error signal.

Thus the weighted coding error signal is computed by filtering the coding error with a weighting filter 35, which can be represented in the frequency domain by a function W(z). For a well-constructed codebook able to approximate the input signal, the weighted coding noise signal with minimum energy is approximately white. That means that the coding noise signal itself has a noise spectrum shaped proportional the inverse of the weighting filter: W(z)−1. By defining W(z)=1−F(z), and noting that the quantizer in FIG. 1*c* searches a codebook to minimize the quantization error between quantizer output and input, it is clear that analysis-by-synthesis quantization can be interpreted as noise shaping quantization.

Once a quantized output signal y(n) is found according to one of the above techniques, indices corresponding to the representation levels selected to represent the samples of the signal are transmitted to the decoder in the encoded signal, such that the quantized signal y(n) can be reconstructed again from those indices in the decoding. In order to efficiently encode these quantization indices, the input to the quantizer is commonly whitened with a prediction filter.

A prediction filter generates predicted values of samples in a signal based on previous samples. In speech coding, it is possible to do this because of correlations present in speech samples (correlation being a statistical measure of a degree of relationship between groups of data). These correlations could be "long-term" correlations between quasi-periodic portions of the speech signal, or "short-term" correlations on a timescale shorter than such periods. The predicted samples are then subtracted from the actual samples to produce a residual signal. This residual signal, i.e. the difference between the predicted and actual samples, typically has a lower energy than the original speech samples and therefore requires fewer bits to quantize. That is, it is only necessary to quantize the difference between the original and predicted signals.

FIG. 1*d* shows an example of a noise shaping quantizer 41 where the quantizer input is whitened using linear prediction filter P(z). The predictor operates in closed-loop, meaning that a prediction of the input signal is based on the quantized output signal. The output of the prediction filter is subtracted from the quantizer input and added to the quantizer output to form the quantized output signal.

Referring to FIG. 1*d*, the noise shaping quantizer 41 comprises a quantization unit 42, a prediction filter 44, a noise shaping filter 45, a first addition stage 46, a second addition stage 47, a first subtraction stage 48 and a second subtraction stage 49. The first subtraction stage 48 calculates the coding error (i.e. coding noise) by taking the difference between the quantized output signal y(n) and the input signal x(n), and supplies the coding noise to the noise shaping filter 45 where it is filtered to generate a filtered output. The quantized output signal y(n) is also supplied to the prediction filter 44 where it is filtered to generate another filtered output. The output of the noise shaping filter 45 is added to the input signal x(n) at the first addition stage 46 and the output of the prediction filter 44 is subtracted from the input signal x(n) at the second subtraction stage 49. The resulting signal is input to the quantization unit 42, to generate an output being a quantized version of its input, and also to generate quantization indices i(n) corresponding to the representation levels selected to represent that input in the quantization. The output of the prediction filter 44 is then added back to the output of the quantization unit 42 at the second addition stage 47 to produce the quantized output signal y(n).

Note that, in the encoder, the quantized output signal y(n) is generated only for feedback to the prediction filter 44 and noise shaping filter 45: it is the quantization indices i(n) that are transmitted to the decoder in the encoded signal. The decoder will then reconstruct the quantized signal y(n) using those indices i(n).

FIG. 1*e* shows another example of a noise shaping quantizer 51 where the quantizer input is whitened using a linear prediction filter P(z). The predictor operates in open-loop manner, meaning that a prediction of the input signal is based on the input signal and a prediction of the output is based on the quantized output signal. The output of the input prediction filter is subtracted from the quantizer input and the output of the output prediction filter is added to the quantizer output to form the quantized output signal.

Referring to FIG. 1*e*, the noise shaping quantizer 51 comprises a quantization unit 52, a first instance of a prediction filter 54, a second instance of the same prediction filter 54', a noise shaping filter 55, a first addition stage 56, a second addition stage 57, a first subtraction stage 58 and a second subtraction stage 59. The quantization unit 52, noise shaping filter 55, and first addition and subtraction stages 56 and 58 are arranged to operate similarly to those of FIG. 1*d*. However, in contrast to FIG. 1*d*, the output of the first addition stage 54 is supplied to the first instance of the prediction filter 54 where it is filtered to generate a filtered output, and this output of the first instance of the prediction filter 54 is then subtracted from the output of the first addition stage 56 at the second subtraction stage 59 before the resulting signal is input to the quantization unit 52. The output of the second instance of the prediction filter 54' is added to the output of the quantization unit 52 at the second addition stage 57 to generate the quantized output signal y(n), and this quantized output signal y(n) is supplied to the second instance of the prediction filter 54' to generate its filtered output.

SUMMARY

According to at least one embodiment, there is provided a method of encoding speech, comprising: receiving an input signal representing a property of speech; quantizing the input signal, thus generating a quantized output signal; prior to said quantization, supplying a version of the input signal to a first noise shaping filter having a first set of filter coefficients, thus generating a first filtered signal based on that version of the input signal and the first set of filter coefficients; following said quantization, supplying a version of the quantized output signal to a second noise shaping filter having a second set of filter coefficients different than said first set, thus generating a second filter signal based on that version of the quantized output signal and the second set of filter coefficients; performing a noise shaping operation to control a frequency spectrum of a noise effect in the quantized output signal caused by said quantization, wherein the noise shaping operation is performed based on both the first and second filtered signals; and transmitting the quantised output signal in an encoded signal.

In embodiments, the method may further comprise updating at least one of the first and second filter coefficients based on a property of the input signal. Said property may comprise at least one of a signal spectrum and a noise spectrum of the input signal. Said updating may be performed at regular time intervals.

The method may further comprise multiplying the input signal by an adjustment gain prior to said quantization, in order to compensate for a difference between said input signal and a signal decoded from said quantized signal that would otherwise be caused by the difference between the first and second noise shaping filters.

Said noise shaping operation may comprise, prior to said quantization, subtracting the first filtered signal from the input signal and adding the second filtered signal to the input signal.

The first noise shaping filter may be an analysis filter and the second noise shaping filter may be a synthesis filter.

Said noise shaping operation may comprise generating a plurality of possible quantized output signals and selecting that having least energy in a weighted error relative to the input signal.

Said noise shaping filters may comprise weighting filters of an analysis-by-synthesis quantizer.

The method may comprise subtracting the output of a prediction filter from the input signal prior to said quantization, and adding the output of a prediction filter to the quantized output signal following said quantization.

According to one or more embodiments, there is provided an encoder for encoding speech, the encoder comprising: an input arranged to receive an input signal representing a property of speech; a quantization unit operatively coupled to said input configured to quantize the input signal, thus generating a quantized output signal; a first noise shaping filter having a first set of filter coefficients and being operatively coupled to said input, arranged to receive a version of the input signal prior to said quantization, and configured to generate a first filtered signal based on that version of the input signal and the first set of filter coefficients; a second noise shaping filter having a second set of filter coefficients different from the first set and being operatively coupled to an output of said quantization unit, arranged to receive a version of the quantized output signal following said quantization, and configured to generate a second filter signal based on that version of the quantized output signal and the second set of filter coefficients; a noise shaping element operatively coupled to the first and second noise shaping filters, and configured to perform a noise shaping operation to control a frequency spectrum of a noise effect in the quantized output signal caused by said quantization, wherein the noise shaping element is further configured to perform the noise shaping operation based on both the first and second filtered signals; and an output arranged to transmit the quantised output signal in an encoded signal.

According to one or more embodiments, there is provided a computer program product for encoding speech, the program comprising code configured so as when executed on a processor to:

receive an input signal representing a property of speech;

quantize the input signal, thus generating a quantized output signal;

prior to said quantization, filter a version of the input signal using a first noise shaping filter having a first set of filter coefficients, thus generating a first filtered signal based on that version of the input signal and the first set of filter coefficients;

following said quantization, filter a version of the quantized output signal using a second noise shaping filter having a second set of filter coefficients different than said first set, thus generating a second filter signal based on that version of the quantized output signal and the second set of filter coefficients;

perform a noise shaping operation to control a frequency spectrum of a noise effect in the quantized output signal caused by said quantization, wherein the noise shaping operation is performed based on both the first and second filtered signals; and output the quantised output signal in an encoded signal.

According to one or more embodiments, there are provided corresponding computer program products such as client application products configured so as when executed on a processor to perform the methods described above.

According to one or more embodiments, there is provided a communication system comprising a plurality of end-user terminals each comprising a corresponding encoder.

BRIEF DESCRIPTION OF THE DRAWINGS

For a better understanding of the described embodiments and to show how it may be carried into effect, reference will now be made by way of example to the accompanying drawings in which.

DETAILED DESCRIPTION

Various embodiments apply one filter to a signal before quantization and another filter with different filter coefficients to a signal after quantization. As will be discussed in more detail below, this allows a signal spectrum and coding noise spectrum to be manipulated separately, and can be applied in order to improve coding efficiency and/or reduce noise.

To achieve the desired noise shaping, either the filter outputs can be combined to create an input to a quantization unit, or the filter outputs can be subtracted to create a weighted speech signal that is minimized by searching a codebook. In one or more embodiments, both filters are updated over time based on a noise shaping analysis of the input signal. The noise shaping analysis determines exactly how the signal and coding noise should be shaped over spectrum and time such that the perceived quality of the resulting quantized output signal is maximized.

Figure 1A:
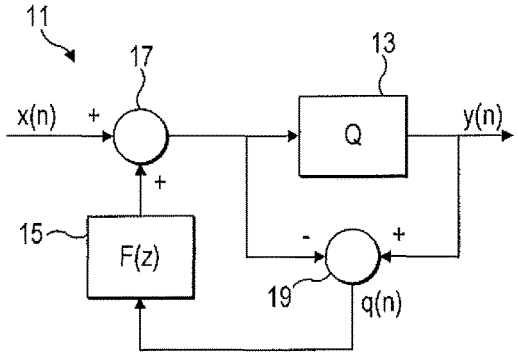
FIG. 1*a* is a schematic diagram of a noise shaping quantizer.
Figure 1B:
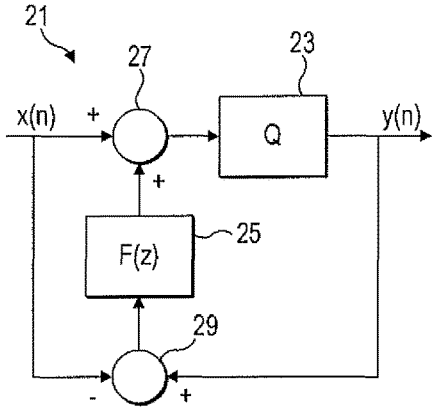
FIG. 1*b* is a schematic diagram of another noise shaping quantizer.
Figure 1C:
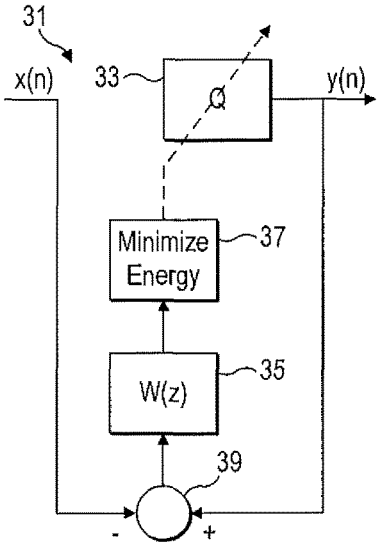
FIG. 1*c* is a schematic diagram of an analysis-by-synthesis quantizer.
Figure 1D:
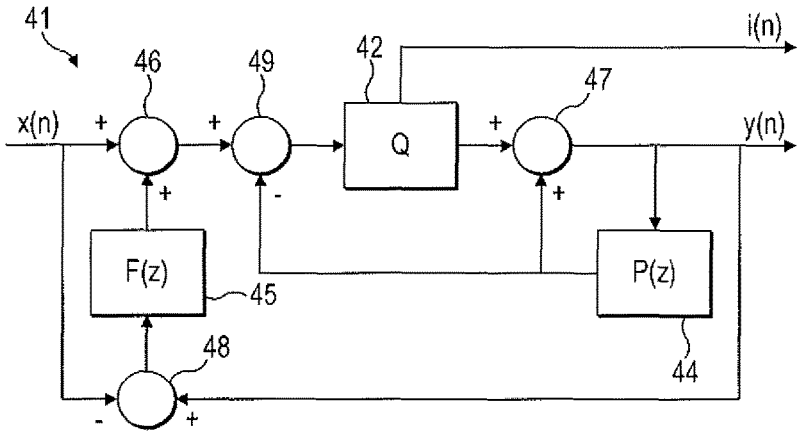
FIG. 1*d* is a schematic diagram of a noise shaping predictive quantizer.
Figure 1E:
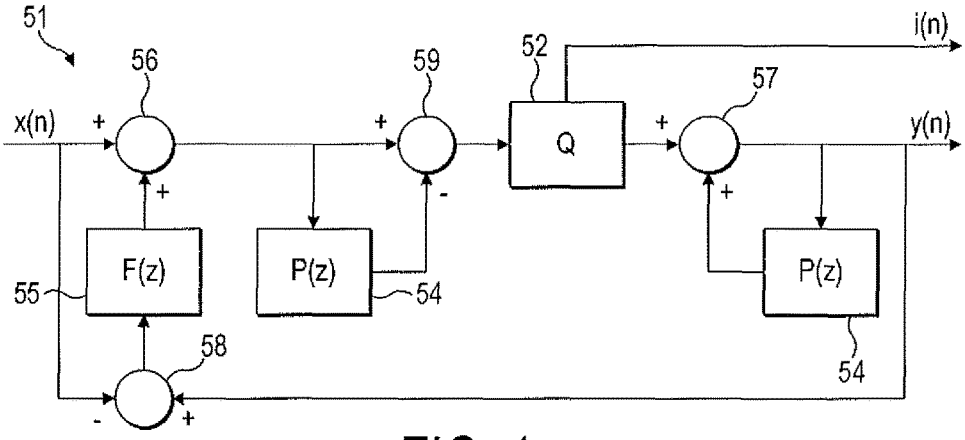
FIG. 1*e* is a schematic diagram of another noise shaping predictive quantizer.
Figure 2A:
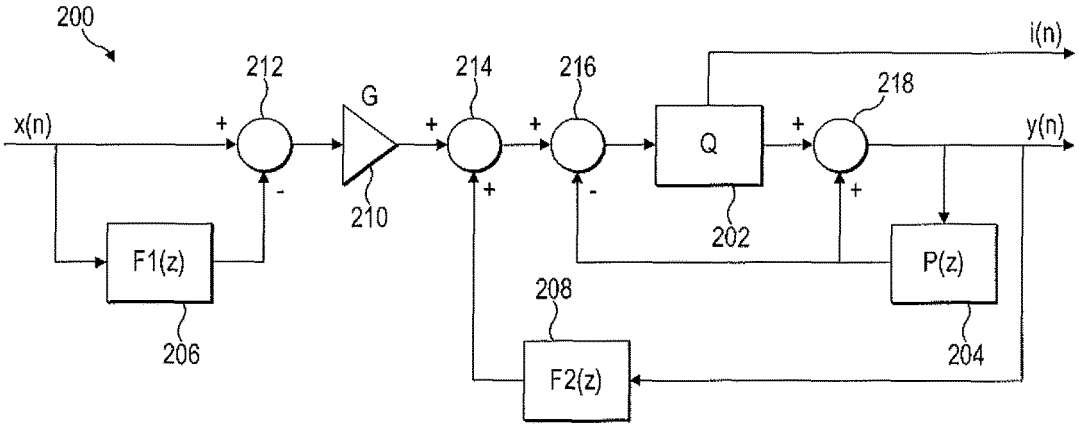
FIG. 2*a* is a schematic diagram of another noise shaping predictive quantizer.

One example of a noise shaping predictive quantizer 200 with different filters for input and output signals is shown in FIG. 2*a*. The noise shaping predictive quantizer 200 comprises a quantization unit 202, a prediction filter 204 in a closed-loop configuration, a first noise shaping filter 206 having first filter coefficients, and a second noise shaping filter 208 having second filter coefficients different from the first filter coefficients. The noise shaping predictive quantizer 200 also comprises an amplifier 210, a first subtraction stage 212, a first addition stage 214, a second subtraction stage 216 and a second addition stage 218.

The first noise shaping filter 206 and the first subtraction stage 212 each have inputs arranged to receive an input signal x(n) representing speech or some property of speech. The other input of the first subtraction stage 212 is coupled to the output of the first noise shaping filter 206, and the output of the first subtraction stage 212 is coupled to the input of the amplifier 210. The output of the amplifier 210 is coupled to an input of the first addition stage 214, and the other input of the first addition stage 214 is coupled to the output of the second noise shaping filter 208. The output of the first addition stage 214 is coupled to an input of the second subtraction stage 216, and the other input of the second subtraction stage is coupled to the output of the prediction filter 204. The output of the second subtraction stage is coupled to the input of the quantization unit 202, which has an output arranged to supply quantization indices i(n) for transmission in an encoded signal over a transmission medium. The quantization unit 202 also has an output arranged to generate a quantized version of its input, and that output is coupled to an input of the second addition stage 218. The other input of the second addition stage 218 is coupled to the output of the prediction filter 204. The output of the second addition stage is thus arranged to generate a quantized output signal y(n), and that output is coupled to the inputs of both the prediction filter 204 and the second noise shaping filter 208.

In operation, the input signal x(n) is filtered by the first noise shaping filter 206, which is an analysis shaping filter which may be represented by a function F1(z) in the frequency domain. The output of this filtering is subtracted from the input signal x(n) at the first subtraction stage 212, and the result of the subtraction is then multiplied by a compensation gain G at the amplifier 210. The second noise shaping filter 208 is a synthesis shaping filter which may be represented by a function F2(z) in the frequency domain. The predictive filter 204 may be represented by a function P(z) in the frequency domain. The output of the second noise shaping filter 208 is added to the output of the amplifier 210 at the first addition stage 214, and the output of the prediction filter 204 is subtracted from the output of the amplifier 210 at the second subtraction stage 216 to obtain the difference between actual and predicted versions of the signal at this point, thus producing the input to the quantization unit 202. The quantization unit 202 quantizes its input, thus producing quantization indices for transmission to a decoder over a transmission medium as part of an encoded signal, and also producing an output which is quantized version of its input. The output of the prediction filter 204 is added to this output of the quantization unit 202 at the second addition stage 218, thus producing the quantized output signal y(n). The quantized output signal is fed back for input to each of the second noise shaping filter 208 F2(z) and the prediction filter 204 to produce their respective filtered outputs (note again that the quantized output y is produced in the encoder only for feedback: it is the quantization indices i which form part of the encoded signal, and these will be used at the decoder to reconstruct the quantised signal y).

In the z-domain (i.e. frequency domain), the quantized output signal of this example can be described as:

$$Y(z) = G \cdot \frac{1 - F1(z)}{1 - F2(z)} X(z) + \frac{1}{1 - F2(z)} Q(z).$$

The equation above shows that the noise shaping with different filters for input and output signal accomplishes two goals. Firstly, the signal spectrum is modified with a pre-processing filter:

$$G \cdot \frac{1 - F1(z)}{1 - F2(z)}.$$

Secondly, the noise spectrum is shaped according to $(1-F2(z))^{-1}$.

Thus, using two different filters allows for an independent manipulation of signal and coding noise spectrum.

Figure 3:
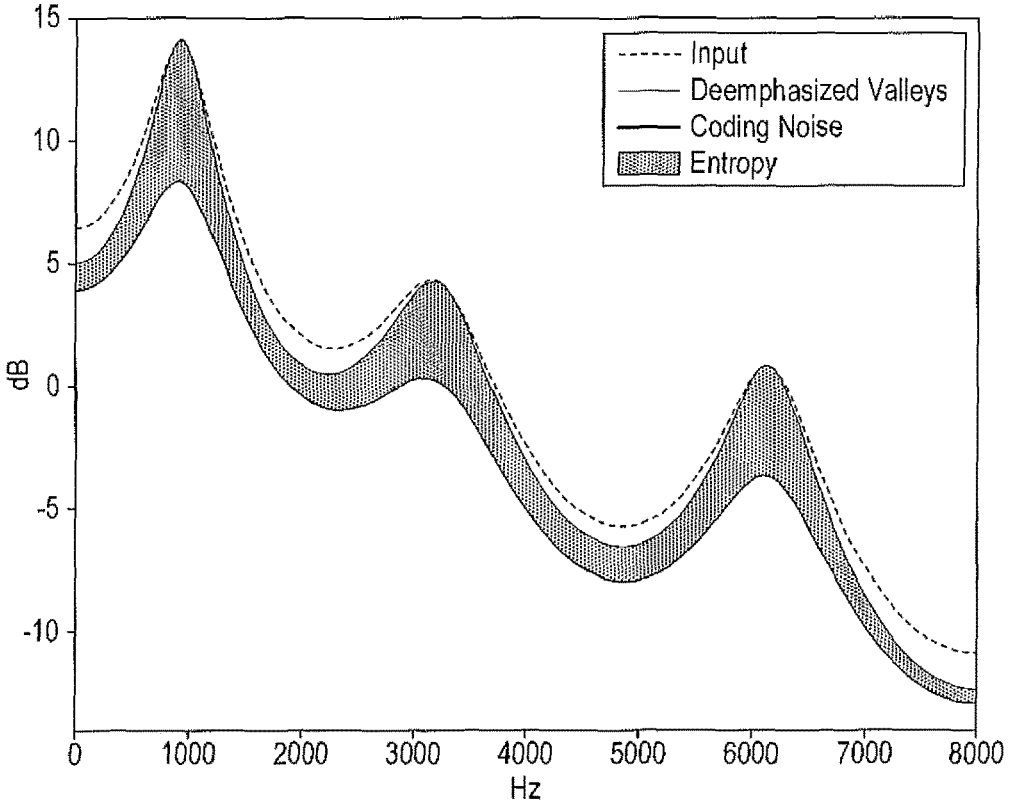
FIG. 3 illustrates a modification to a signal frequency spectrum.

Modifying the signal spectrum in such a manner can be used to produce two advantageous effects. The first effect is to suppress, or deemphasize, the values in between speech formants using short-term shaping and the valleys in between speech harmonics using long-term shaping. The effect of this suppression is to reduce the entropy of the signal relative to the coding noise level, thereby increasing the efficiency of the encoder. An example of this effect is demonstrated in FIG. 3, which is a frequency spectrum graph (i.e. of signal power or energy vs. frequency) showing a reduced entropy by de-emphasizing the valleys in between speech formants. The top curve shows an input signal, the middle curve shows the de-emphasised valleys, and the lower curve shows the coding noise. By reducing the signal spectrum in the valleys between the spectral peaks, while keeping the coding noise spectrum constant, the entropy, as defined as the area between the signal and noise spectra, is reduced.

The second effect that can be achieved by modifying the signal spectrum is to reduce noise in the input signal. By estimating the signal spectrum and noise spectrum of the signal at regular time intervals, the analysis and synthesis shaping filters (i.e. first and second noise shaping filters 206 and 208) can be configured such that the parts of the spectrum with a low signal-to-noise ratio are attenuated while parts of the spectrum with a high signal-to-noise ratio are left substantially unchanged.

A noise shaping analysis can be performed to update the analysis and synthesis shaping filters F1(z) and F2(z) in a joint manner.

Figure 2B:
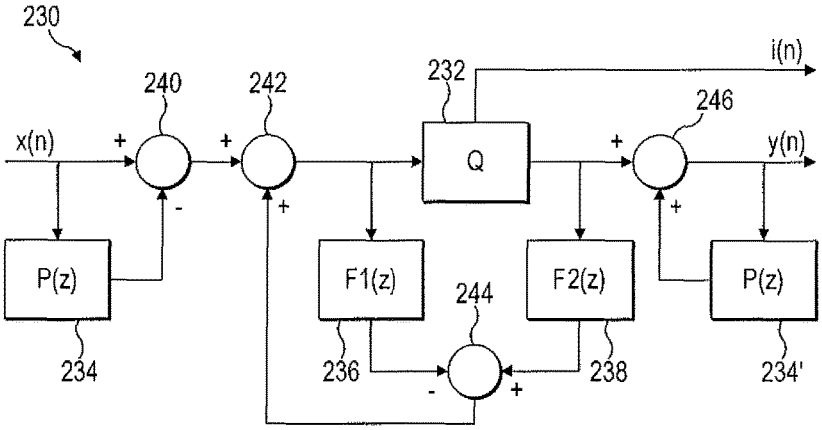
FIG. 2*b* is a schematic diagram of another noise shaping predictive quantizer.

FIG. 2*b* shows an alternative implementation of a noise shaping predictive quantizer 230, again with different filters for input and output signals but this time based on open-loop prediction instead of closed loop. The noise shaping predictive quantizer 230 comprises a quantization unit 232, a first instance of a prediction filter 234, a second instance of the prediction filter 234', a first noise shaping filter 236 having first filter coefficients, an a second noise shaping filter 238 having second filter coefficients. The noise shaping predictive quantizer 230 further comprises a first subtraction stage 240, a first addition stage 242, a second subtraction stage 244 and a second addition stage 246.

The first subtraction stage 240 and the first instance of the prediction filter 234 each have inputs arranged to receive the input signal x(n). The other input of the first subtraction stage 240 is coupled to the output of the first instance of the prediction filter 234, and the output of the first subtraction stage is coupled to the input of the first addition stage 242. The other input of the first addition stage 242 is coupled to the output of the second subtraction stage 244, and the output of the first addition stage 242 is coupled to the inputs of the quantization unit 232 and the first noise shaping filter 236. The quantization unit 232 has an output arranged to supply quantization indices i(n), and another output arranged to generate a quantized version of its input. The latter output is coupled to an input of the second addition stage 246 and to the input of the second noise shaping filter 238. The outputs of the first and second noise shaping filters 236 and 238 are coupled to respective inputs of the second subtraction stage 244. The output of the second addition stage 246 is coupled to the input of the second instance of the prediction filter 234', and the output of the second instance of the prediction filter 234' fed back to the other input of the second addition stage 246. The signal output from the second addition stage 246 is the quantized output signal y(n), as will be reconstructed using the indices i(n) at the decoder.

In operation, the prediction is done open loop, meaning that a prediction of the input signal is based on the input signal and a prediction of the output is based on the quantized output signal. Also, noise shaping is done by filtering the input and output of the quantizer instead of the input and output of the codec. The input signal x(n) is supplied to the first instance of the prediction filter 234, which may be represented by a function P(z) in the frequency domain. The first instance of the prediction filter 234 thus produces a filtered output based on the input signal x(n), which is then subtracted from the input signal x(n) at the first subtraction stage 240 to obtain the difference between the actual and predicted input signals. Also, the second subtraction stage 244 takes the difference between the filtered outputs of the first and second noise shaping filters 236 and 238, which may be represented by functions F1(z) and F2(z) respectively in the frequency domain. These two differences are added together at the first addition stage 242. The resulting signal is supplied as an input to the quantization unit 232, and also supplied to the input of the first noise shaping filter 236 in order to produce its respective filtered output. The quantization unit 202 quantizes its input, thus producing quantization indices for transmission to a decoder, and also producing an output which is quantized version of its input. This quantized output is supplied to an input of the second addition stage 246, and also supplied to the second noise shaping filter 238 in order to produce its respective filtered output. At the second addition stage 246 the output of the second instance of the prediction filter 234' is added to the quantized output of the quantization unit 232, thus producing the quantized output signal y(n), which is fed back to the input of the second instance of the prediction filter 234' to produce its respective filtered output.

In the z-domain (i.e. frequency domain), the quantized output signal of this example can be described as:

$$Y(z) = \frac{1}{1 + F1(z) - F2(z)} X(z) + \frac{1 + F1(z)}{1 + F1(z) - F2(z)} Q(z).$$

Again, it can be seen that using two different filters allows for an independent manipulation of signal and coding noise spectrum.

Figure 2C:
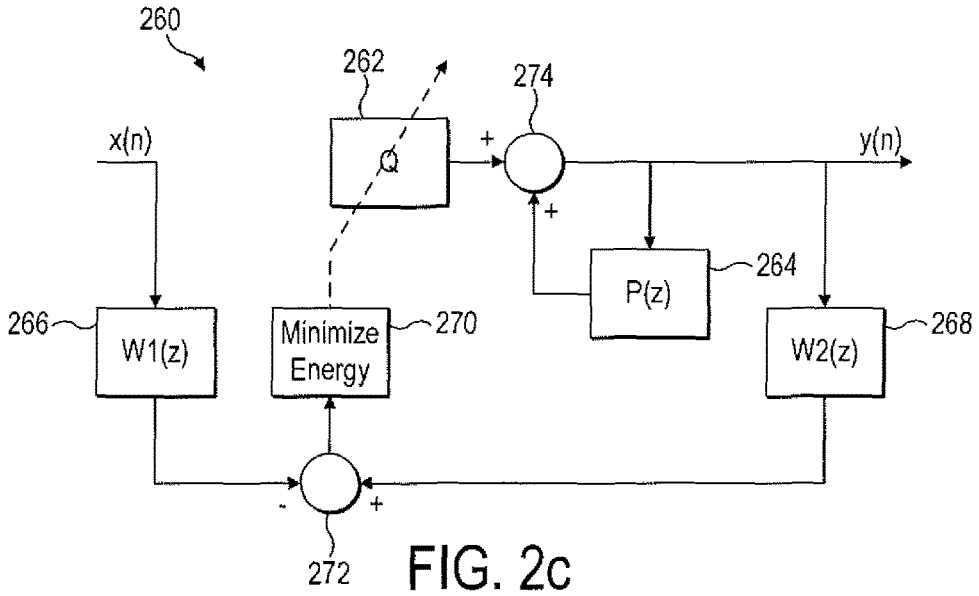
FIG. 2*c* is a schematic diagram of a predictive analysis-by-synthesis quantizer.

A further embodiment is now described in relation to FIG. 2*c*, which shows an analysis-by-synthesis predictive quantizer 260 with different filters for input and output signals. The analysis-by-synthesis predictive quantizer 260 comprises a controllable quantization unit 262, a prediction filter 264, a first weighting filter 266, a second weighting filter 268, an energy minimization block 270, a subtraction stage 272 and an addition stage 274. The first weighting filter has its input arranged to receive the input signal x(n), and its output coupled to an input of the subtraction stage 272. The other input of the subtraction stage 272 is coupled to the output of the second weighting filter 268. The output of the subtraction stage is coupled to the input of the energy minimization block 270, and the output of the energy minimization block 270 is coupled to a control input of the quantization unit 262. The quantization unit 262 has outputs arranged to supply quantization indices i(n) and a quantized output respectively. The latter output of the quantization unit 262 is coupled to an input of the addition stage 274, and the other input of the addition stage is coupled to the output of the prediction filter 264. The output of the addition stage 274 is coupled to the inputs of the prediction filter 264 and the second weighting filter 268. The signal output from the addition stage 264 is the quantized output signal y(n), as will be reconstructed using the indices i(n) at the decoder.

In operation, the input and output signals are filtered with analysis and synthesis weighting filters.

The quantization unit 262 generates a plurality of possible versions of a portion of the quantized output signal y(n). For each possible version, the addition stage 274 adds the quantized output of the quantization unit 262 to the filtered output of the prediction filter 264, thus producing the quantized output signal y(n) which is fed back to the inputs of the prediction filter 264 and the second weighting filter 268 to produce their respective filtered outputs. Also, the input signal x(n) is filtered by the first weighting filter 266 to produce a respective filtered output. The prediction filter 264 and first and second weighting filters 266 and 268 may be represented by functions P(z), W1(z) and W2(z) respectively in the frequency domain. The subtraction stage 272 takes the difference between the filtered outputs of the first and second weighting filters 266 and 268 to produce an error signal, which is supplied to the input of energy minimization block 270. The energy minimization block 270 determines the energy in this error signal for each possible version of the quantized output signal y(n), and selects the version resulting in the least energy in the error signal.

In the frequency domain, the output signal of this example can be described as:

$$Y(z) = \frac{W1(z)}{W2(z)} X(z) + \frac{1}{W2(z)} Q(z).$$

Again therefore, using two different filters allows for an independent manipulation of signal and coding noise spectrum.

Remember that by defining W(z)=1−F(z), analysis-by-synthesis quantization can be interpreted as noise shaping quantization. Thus a suitably configured weighting filter can be considered as a noise shaping filter.

An example implementation in the context of speech coding is now discussed.

Figure 4A:
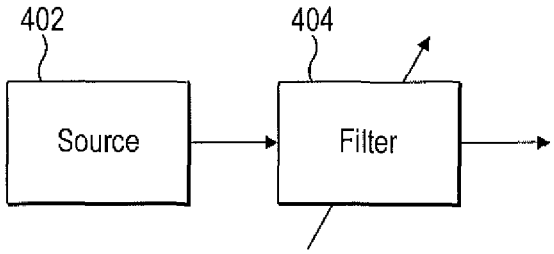
FIG. 4*a* is a schematic representation of a source-filter model of speech.

As illustrated schematically in FIG. 4*a*, according to a source-filter model speech can be modelled as comprising a signal from a source 402 passed through a time-varying filter 404. The source signal represents the immediate vibration of the vocal chords, and the filter represents the acoustic effect of the vocal tract formed by the shape of the throat, mouth and tongue. The effect of the filter is to alter the frequency profile of the source signal so as to emphasise or diminish certain frequencies. Instead of trying to directly represent an actual waveform, speech encoding works by representing the speech using parameters of a source-filter model.

Figure 4B:
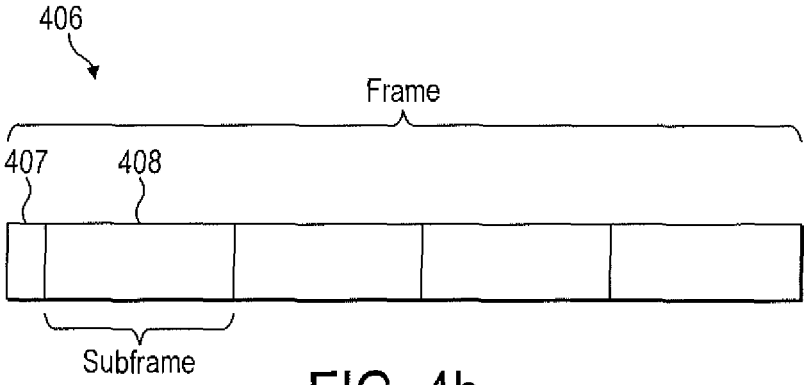
FIG. 4*b* is a schematic representation of a frame.

As illustrated schematically in FIG. 4*b*, the encoded signal will be divided into a plurality of frames 406, with each frame comprising a plurality of subframes 408. For example, speech may be sampled at 16 kHz and processed in frames of 20 ms, with some of the processing done in subframes of 5 ms (four subframes per frame). Each frame comprises a flag 407 by which it is classed according to its respective type. Each frame is thus classed at least as either "voiced" or "unvoiced", and unvoiced frames are encoded differently than voiced frames. Each subframe 408 then comprises a set of parameters of the source-filter model representative of the sound of the speech in that subframe.

Figure 4C:
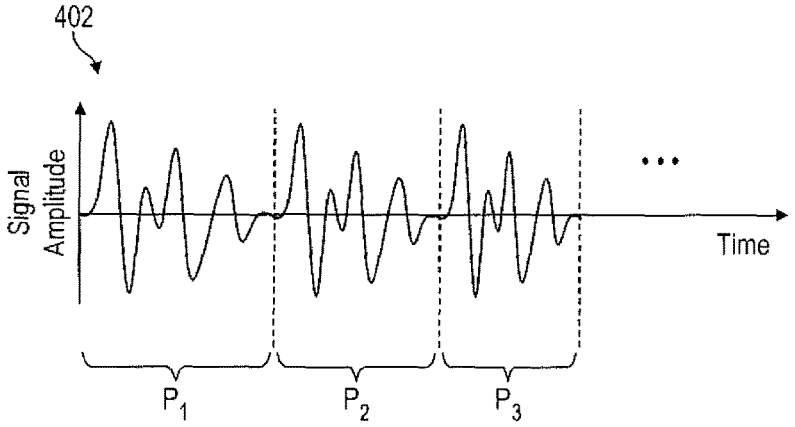
FIG. 4*c* is a schematic representation of a source signal.

For voiced sounds (e.g. vowel sounds), the source signal has a degree of long-term periodicity corresponding to the perceived pitch of the voice. In that case, the source signal can be modelled as comprising a quasi-periodic signal, with each period corresponding to a respective "pitch pulse" comprising a series of peaks of differing amplitudes. The source signal is said to be "quasi" periodic in that on a timescale of at least one subframe it can be taken to have a single, meaningful period which is approximately constant; but over many subframes or frames then the period and form of the signal may change. The approximated period at any given point may be referred to as the pitch lag. An example of a modelled source signal 402 is shown schematically in FIG. 4*c* with a gradually varying period $P_1$, $P_2$, $P_3$, etc., each comprising a pitch pulse of four peaks which may vary gradually in form and amplitude from one period to the next.

As mentioned, prediction filtering may be used to derive a residual signal having less energy that an input speech signal and therefore requiring fewer bits to quantize.

Figure 4D:
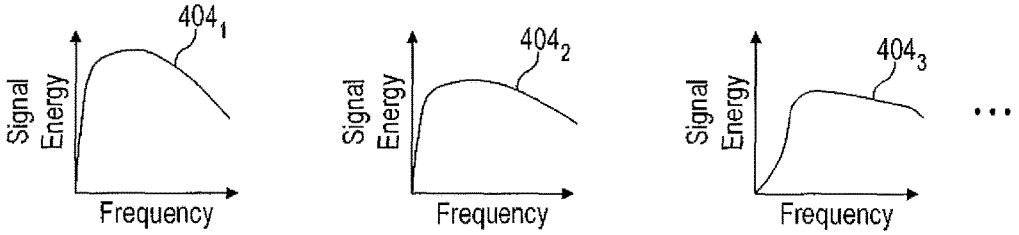
FIG. 4*d* is a schematic representation of variations in a spectral envelope.

According to many speech coding algorithms such as those using Linear Predictive Coding (LPC), a short-term prediction filter is used to separate out the speech signal into two separate components: (i) a signal representative of the effect of the time-varying filter 404; and (ii) the remaining signal with the effect of the filter 404 removed, which is representative of the source signal. The signal representative of the effect of the filter 404 may be referred to as the spectral envelope signal, and typically comprises a series of sets of LPC parameters describing the spectral envelope at each stage. FIG. 4*d* shows a schematic example of a sequence of spectral envelopes 4041, 4042, 4043, etc. varying over time. Once the varying spectral envelope is removed, the remaining signal representative of the source alone may be referred to as the LPC residual signal, as shown schematically in FIG. 4*c*. The LPC short-term filtering works by using an LPC analysis to determine a short-term correlation in recently received samples of the speech signal (i.e. short-term compared to the pitch period), then passing coefficients of that correlation to an LPC synthesis filter to predict following samples. The predicted samples are fed back to the input where they are subtracted from the speech signal, thus removing the effect of the spectral envelope and thereby deriving an LTP residual signal representing the modelled source of the speech. The LPC residual signal has less energy that the input speech signal and therefore requiring fewer bits to quantize.

The spectral envelope signal and the source signal are each encoded separately for transmission. In the illustrated example, each subframe 406 would contain: (i) a set of parameters representing the spectral envelope 404; and (ii) an LPC residual signal representing the source signal 402 with the effect of the short-term correlations removed.

To further improve the encoding of the source signal, its periodicity may also be exploited. To do this, a long-term prediction (LTP) analysis is used to determine the correlation of the LPC residual signal with itself from one period to the next, i.e. the correlation between the LPC residual signal at the current time and the LPC residual signal after one period at the current pitch lag (correlation being a statistical measure of a degree of relationship between groups of data, in this case the degree of repetition between portions of a signal). In this context the source signal can be said to be "quasi" periodic in that on a timescale of at least one correlation calculation it can be taken to have a meaningful period which is approximately (but not exactly) constant; but over many such calculations then the period and form of the source signal may change more significantly. A set of parameters derived from this correlation are determined to at least partially represent the source signal for each subframe. The set of parameters for each subframe is typically a set of coefficients C of a series, which form a respective vector $C_{LTP}=(C_1, C_2, \ldots C_i)$.

The effect of this inter-period correlation is then removed from the LPC residual, leaving an LTP residual signal representing the source signal with the effect of the correlation between pitch periods removed. To do this, an LTP analysis is used to determine a correlation between successive received pitch pulses in the LPC residual signal, then coefficients of that correlation are passed to an LTP synthesis filter where they are used to generate a predicted version of the later of those pitch pulses from the last stored one of the preceding pitch pulses. The predicted pitch pulse is fed back to the input where it is subtracted from the corresponding portion of the actual LPC residual signal, thus removing the effect of the periodicity and thereby deriving an LTP residual signal. Put another way, the LTP synthesis filter uses a long-term prediction to effectively remove or reduce the pitch pulses from the LPC residual signal, leaving an LTP residual signal having lower energy than the LPC residual. To represent the source signal, the LTP vectors and LTP residual signal are encoded separately for transmission.

The sets of LPC parameters, the LTP vectors and the LTP residual signal are each quantised prior to transmission (quantisation being the process of converting a continuous range of values into a set of discrete values, or a larger approximately continuous set of discrete values into a smaller set of discrete values). The advantage of separating out the LPC residual signal into the LTP vectors and LTP residual signal is that the LTP residual typically has a lower energy than the LPC residual, and so requires fewer bits to quantize.

So in the illustrated example, each subframe 406 would comprise: (i) a quantised set of LPC parameters representing the spectral envelope, (ii)(a) a quantised LTP vector related to the correlation between pitch periods in the source signal, and (ii)(b) a quantised LTP residual signal representative of the source signal with the effects of this inter-period correlation removed.

In contrast with voiced sounds, for unvoiced sounds such as plosives (e.g. "T" or "P" sounds) the modelled source signal has no substantial degree of periodicity. In that case, long-term prediction (LTP) cannot be used and the LPC residual signal representing the modelled source signal is instead encoded differently, e.g. by being quantized directly.

Figure 5:
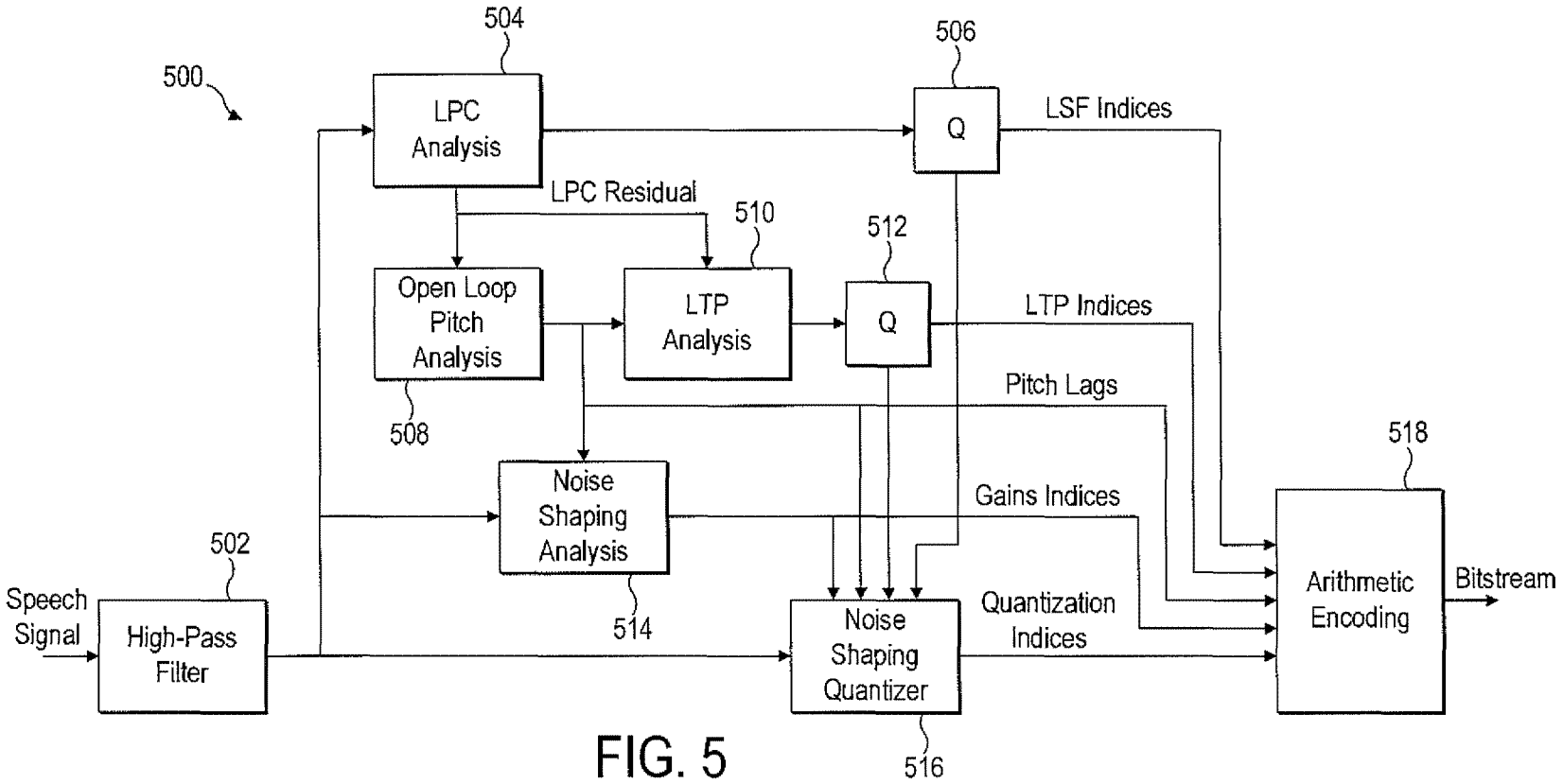
FIG. 5 is a schematic diagram of an encoder.

An example of an encoder 500 for implementing one or more embodiments is now described in relation to FIG. 5.

The encoder 500 comprises a high-pass filter 502, a linear predictive coding (LPC) analysis block 504, a first vector quantizer 506, an open-loop pitch analysis block 508, a long-term prediction (LTP) analysis block 510, a second vector quantizer 512, a noise shaping analysis block 514, a noise shaping quantizer 516, and an arithmetic encoding block 518. The noise shaping quantizer 516 could be of the type of any of the quantizers 200, 230 or 260 discussed in relation to FIGS. 2*a*, 2*b* and 2*c* respectively.

The high pass filter 502 has an input arranged to receive an input speech signal from an input device such as a microphone, and an output coupled to inputs of the LPC analysis block 504, noise shaping analysis block 514 and noise shaping quantizer 516. The LPC analysis block has an output coupled to an input of the first vector quantizer 506, and the first vector quantizer 506 has outputs coupled to inputs of the arithmetic encoding block 518 and noise shaping quantizer 516. The LPC analysis block 504 has outputs coupled to inputs of the open-loop pitch analysis block 508 and the LTP analysis block 510. The LTP analysis block 510 has an output coupled to an input of the second vector quantizer 512, and the second vector quantizer 512 has outputs coupled to inputs of the arithmetic encoding block 518 and noise shaping quantizer 516. The open-loop pitch analysis block 508 has outputs coupled to inputs of the LTP 510 analysis block 510 and the noise shaping analysis block 514. The noise shaping analysis block 514 has outputs coupled to inputs of the arithmetic encoding block 518 and the noise shaping quantizer 516. The noise shaping quantizer 516 has an output coupled to an input of the arithmetic encoding block 518. The arithmetic encoding block 518 is arranged to produce an output bitstream based on its inputs, for transmission from an output device such as a wired modem or wireless transceiver.

In operation, the encoder processes a speech input signal sampled at 16 kHz in frames of 20 milliseconds, with some of the processing done in subframes of 5 milliseconds. The output bitstream payload contains arithmetically encoded parameters, and has a bitrate that varies depending on a quality setting provided to the encoder and on the complexity and perceptual importance of the input signal.

The speech input signal is input to the high-pass filter 504 to remove frequencies below 80 Hz which contain almost no speech energy and may contain noise that can be detrimental to the coding efficiency and cause artifacts in the decoded output signal. In at least some embodiments, the high-pass filter 504 is a second order auto-regressive moving average (ARMA) filter.

The high-pass filtered input $x_{HP}$ is input to the linear prediction coding (LPC) analysis block 504, which calculates 16 LPC coefficients a(i) using the covariance method which minimizes the energy of the LPC residual $r_{LPC}$:

$$r_{LPC}(n) = x_{HP}(n) - \sum_{i=1}^{16} x_{HP}(n-i)a(i).$$

The LPC coefficients are transformed to a line spectral frequency (LSF) vector. The LSFs are quantized using the first vector quantizer 506, a multi-stage vector quantizer (MSVQ) with 10 stages, producing 10 LSF indices that together represent the quantized LSFs. The quantized LSFs are transformed back to produce the quantized LPC coefficients $a_Q$ for use in the noise shaping quantizer 516.

The LPC residual is input to the open loop pitch analysis block 508, producing one pitch lag for every 5 millisecond subframe, i.e., four pitch lags per frame. The pitch lags are chosen between 32 and 288 samples, corresponding to pitch frequencies from 56 to 500 Hz, which covers the range found in typical speech signals. Also, the pitch analysis produces a pitch correlation value which is the normalized correlation of the signal in the current frame and the signal delayed by the pitch lag values. Frames for which the correlation value is below a threshold of 0.5 are classified as unvoiced, i.e., containing no periodic signal, whereas all other frames are classified as voiced. The pitch lags are input to the arithmetic coder 518 and noise shaping quantizer 516.

For voiced frames, a long-term prediction analysis is performed on the LPC residual. The LPC residual $r_{LPC}$ is supplied from the LPC analysis block 504 to the LTP analysis block 510. For each subframe, the LTP analysis block 510 solves normal equations to find 5 linear prediction filter coefficients b(i) such that the energy in the LTP residual $r_{LTP}$ for that subframe:

$$r_{LTP}(n) = r_{LPC}(n) - \sum_{i=-2}^{2} r_{LPC}(n - \text{lag} - i)b(i)$$

is minimized. The normal equations are solved as:

$$b = W_{LTP}^{-1} C_{LTP},$$

where $W_{LTP}$ is a weighting matrix containing correlation values $$W_{LTP}(i, j) = \sum_{n=0}^{79} r_{LPC}(n + 2 - \text{lag} - i) r_{LPC}(n + 2 - \text{lag} - j),$$

and $C_{LTP}$ is a correlation vector:

$$C_{LTP}(i) = \sum_{n=0}^{79} r_{LPC}(n) r_{LPC}(n + 2 - \text{lag} - i).$$

Thus, the LTP residual is computed as the LPC residual in the current subframe minus a filtered and delayed LPC residual. The LPC residual in the current subframe and the delayed LPC residual are both generated with an LPC analysis filter controlled by the same LPC coefficients. That means that when the LPC coefficients were updated, an LPC residual is computed not only for the current frame but also a new LPC residual is computed for at least lag+2 samples preceding the current frame.

The LTP coefficients for each frame are quantized using a vector quantizer (VQ). The resulting VQ codebook index is input to the arithmetic coder, and the quantized LTP coefficients $b_Q$ are input to the noise shaping quantizer 516.

The high-pass filtered input is analyzed by the noise shaping analysis block 514 to find filter coefficients and quantization gains used in the noise shaping quantizer. The filter coefficients determine the distribution of the coding noise over the spectrum, and are chose such that the quantization is least audible. The quantization gains determine the step size of the residual quantizer and as such govern the balance between bitrate and coding noise level.

All noise shaping parameters are computed and applied per subframe of 5 milliseconds, except for the quantization offset which is determines once per frame of 20 milliseconds. First, a $16^{th}$ order noise shaping LPC analysis is performed on a windowed signal block of 16 milliseconds. The signal block has a look-ahead of 5 milliseconds relative to the current subframe, and the window is an asymmetric sine window. The noise shaping LPC analysis is done with the autocorrelation method. The quantization gain is found as the square-root of the residual energy from the noise shaping LPC analysis, multiplied by a constant to set the average bitrate to the desired level. For voiced frames, the quantization gain is further multiplied by 0.5 times the inverse of the pitch correlation determined by the pitch analyses, to reduce the level of coding noise which is more easily audible for voiced signals. The quantization gain for each subframe is quantized, and the quantization indices are input to the arithmetically encoder 518. The quantized quantization gains are input to the noise shaping quantizer 516.

According to one or more embodiments, the noise shaping analysis block 514 determines separate analysis and synthesis noise shaping filter coefficients. The short-term analysis and synthesis noise shaping coefficients $a_{shape,ana}(i)$ and $a_{shape,syn}(i)$ are (i) obtained by applying bandwidth expansion to the coefficients found in the noise shaping LPC analysis. This bandwidth expansion moves the roots of the noise shaping LPC polynomial towards the origin, according to the formula:

$$a_{shape,ana}(i)=a_{autocorr}(i)g_{ana}{}^{i}$$

and $$a\text{shape,syn}(i)=a\text{autocorr}(i)\text{gsyn}i$$

where $a_{autocorr}(i)$ is the ith coefficient from the noise shaping LPC analysis and for the bandwidth expansion factors good results are obtained with: $g_{ana}=0.9$ and $g_{syn}=0.96$.

For voiced frames, the noise shaping quantizer 516 also applies long-term noise shaping. It uses three filter taps in analysis and synthesis long-term noise shaping filters, described by:

$$b_{shape,ana}=0.4\text{sqrt(PitchCorrelation)}[0.25,0.5,0.25]$$

and $$b_{shape,syn}=0.5\text{sqrt(PitchCorrelation)}[0.25,0.5,0.25].$$

The short-term and long-term noise shaping coefficients are determined by the noise shaping analysis block 514 and input to the noise shaping quantizer 516.

In one or more embodiments, an adjustment gain G serves to correct any level mismatch between original and decoded signal that might arise from the noise shaping and de-emphasis. This gain is computed as the ratio of the prediction gain of the short-term analysis and synthesis shaping filter coefficients. The prediction gain of an LPC synthesis filter is the square-root of the output energy when the filter is excited by a unit-energy impulse on the input. An efficient way to compute the prediction gain is by first computing the reflection coefficients from the LPC coefficients through the step-down algorithm, and extracting the prediction gain from the reflection coefficients as:

$$predGain=\left(\prod_{k=1}^{K}1-r_k^2\right)^{-0.5},$$

where $r_k$ are the reflection coefficients.

The high-pass filtered input $x_{HP}(n)$ is input to the noise shaping quantizer 516, discussed in more detail in relation to FIG. 6*b* below. All gains and filter coefficients and gains are updated for every subframe, except for the LPC coefficients which are updated once per frame.

Figure 6A:
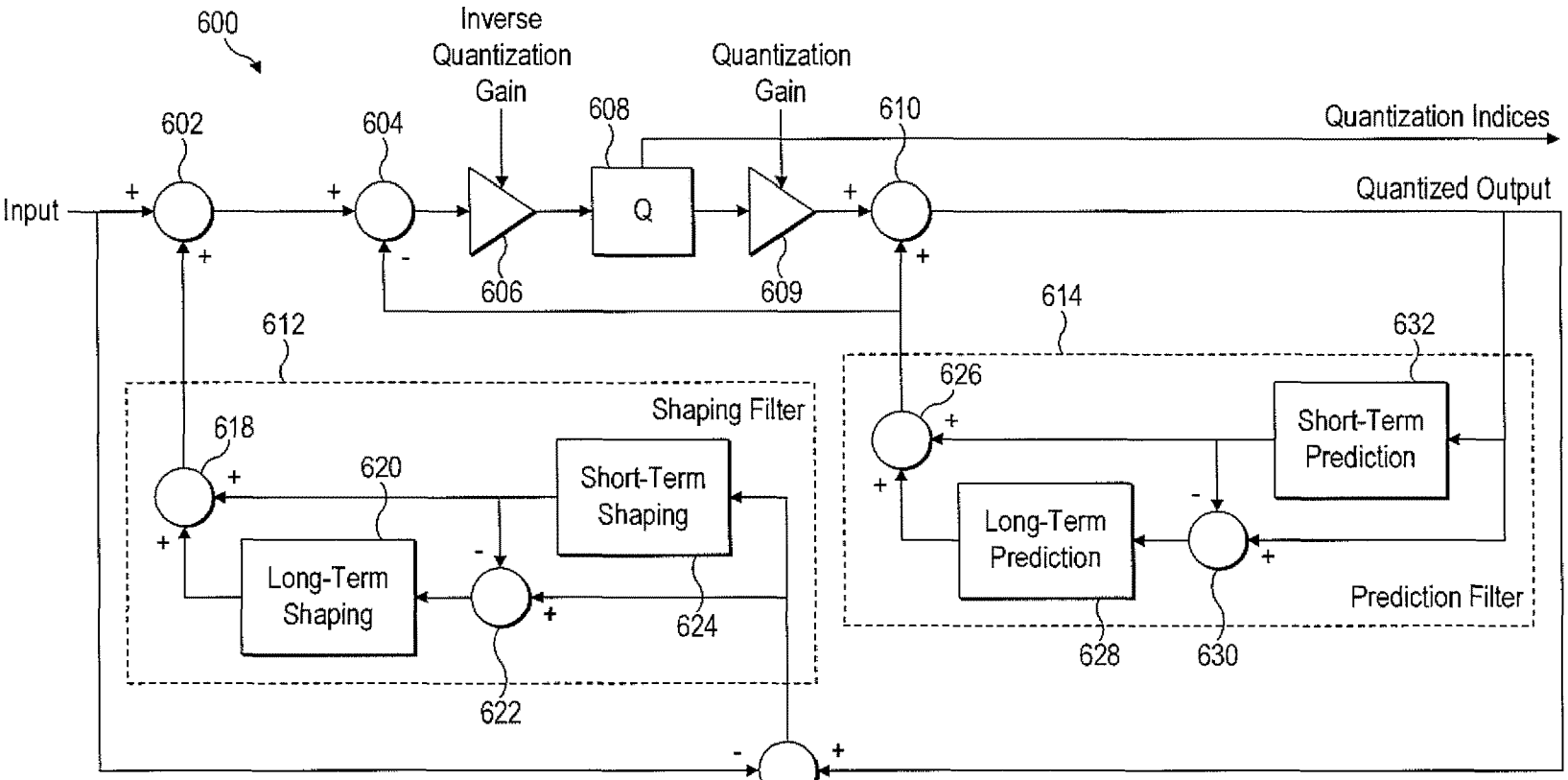
FIG. 6*a* is another schematic diagram of a noise shaping predictive quantizer.

By way of contrast with the described embodiments, an example of a noise shaping quantizer 600 without separate noise shaping filters at the inputs and outputs is first described in relation to FIG. 6*a*.

The noise shaping quantizer 600 comprises a first addition stage 602, a first subtraction stage 604, a first amplifier 606, a quantization unit 608, a second amplifier 609, a second addition stage 610, a shaping filter 612, a prediction filter 614 and a second subtraction stage 616. The shaping filter 612 comprises a third addition stage 618, a long-term shaping block 620, a third subtraction stage 622, and a short-term shaping block 624. The prediction filter 614 comprises a fourth addition stage 626, a long-term prediction block 628, a fourth subtraction stage 630, and a short-term prediction block 632.

The first addition stage 602 has an input that would be arranged to receive the high-pass filtered input from the high-pass filter 502, and another input coupled to an output of the third addition stage 618. The first subtraction stage has inputs coupled to outputs of the first addition stage 602 and fourth addition stage 626. The first amplifier has a signal input coupled to an output of the first subtraction stage and an output coupled to an input of the quantization unit 608. The first amplifier 606 also has a control input which would be coupled to the output of the noise shaping analysis block 514. The quantization unit 608 has an output coupled to input of the second amplifier 609 and would also have an output coupled to the arithmetic encoding block 518. The second amplifier 609 would also have a control input coupled to the output of the noise shaping analysis block 514, and an output coupled to the an input of the second addition stage 610. The other input of the second addition stage 610 is coupled to an output of the fourth addition stage 626. An output of the second addition stage is coupled back to the input of the first addition stage 602, and to an input of the short-term prediction block 632 and the fourth subtraction stage 630. An output of the short-term prediction block 632 is coupled to the other input of the fourth subtraction stage 630. The output of the fourth subtraction stage 630 is coupled to the input of the long-term prediction block 628. The fourth addition stage 626 has inputs coupled to outputs of the long-term prediction block 628 and short-term prediction block 632. The output of the second addition stage 610 is further coupled to an input of the second subtraction stage 616, and the other input of the second subtraction stage 616 is coupled to the input from the high-pass filter 502. An output of the second subtraction stage 616 is coupled to inputs of the short-term shaping block 624 and the third subtraction stage 622. An output of the short-term shaping block 624 is coupled to the other input of the third subtraction stage 622. The output of the third subtraction stage 622 is coupled to the input of the long-term shaping block 620. The third addition stage 618 has inputs coupled to outputs of the long-term shaping block 620 and short-term shaping block 624. The short-term and long-term shaping blocks 624 and 620 would each also be coupled to the noise shaping analysis block 514, the long-term shaping block 620 would also be coupled to the open-loop pitch analysis block 508 (connections not shown). Further, the short-term prediction block 632 would be coupled to the LPC analysis block 504 via the first vector quantizer 506, and the long-term prediction block 628 would be coupled to the LTP analysis block 510 via the second vector quantizer 512 (connections also not shown).

In operation, the noise shaping quantizer 600 generates a quantized output signal that is identical to the output signal ultimately generated in the decoder.

The input signal is subtracted from this quantized output signal at the second subtraction stage 616 to obtain the coding noise signal d(n). The coding noise signal is input to a shaping filter 612, described in detail later. The output of the shaping filter 612 is added to the input signal at the first addition stage 602 in order to effect the spectral shaping of the coding noise. From the resulting signal, the output of the prediction filter 614, described in detail below, is subtracted at the first subtraction stage 604 to create a residual signal. The residual signal would be multiplied at the first amplifier 606 by the inverse quantized quantization gain from the noise shaping analysis block 514, and input to the scalar quantizer 608. The quantization indices of the scalar quantizer 608 represent an excitation signal that would be input to the arithmetically encoder 518. The scalar quantizer 608 also outputs a quantization signal, which would be multiplied at the second amplifier 609 by the quantized quantization gain from the noise shaping analysis block 514 to create an excitation signal. The output of the prediction filter 614 is added at the second addition stage to the excitation signal to form the quantized output signal. The quantized output signal is input to the prediction filter 614.

On a point of terminology, note that there is a small difference between the terms "residual" and "excitation". A residual is obtained by subtracting a prediction from the input speech signal. An excitation is based on only the quantizer output. Often, the residual is simply the quantizer input and the excitation is its output.

The shaping filter 612 inputs the coding noise signal d(n) to a short-term shaping filter 624, which uses the short-term shaping coefficients $a_{shape}$ to create a short-term shaping signal $s_{short}(n)$, according to the formula:

$$s_{short}(n) = \sum_{i=1}^{16} d(n-i)a_{shape}(i).$$

The short-term shaping signal is subtracted at the third addition stage 622 from the coding noise signal to create a shaping residual signal f(n). The shaping residual signal is input to a long-term shaping filter 620 which uses the long-term shaping coefficients $b_{shape}$ to create a long-term shaping signal $s_{long}(n)$, according to the formula:

$$s_{long}(n) = \sum_{i=-2}^{2} f(n-\text{lag}-i)b_{shape}(i).$$

The short-term and long-term shaping signals are added together at the third addition stage 618 to create the shaping filter output signal.

The prediction filter 614 inputs the quantized output signal y(n) to a short-term prediction filter 632, which uses the quantized LPC coefficients $a_i$ to create a short-term prediction signal $p_{short}(n)$, according to the formula:

$$p_{short}(n) = \sum_{i=1}^{16} y(n-i)a(i).$$

The short-term prediction signal is subtracted at the fourth subtraction stage 630 from the quantized output signal to create an LPC excitation signal $e_{LPC}(n)$. The LPC excitation signal is input to a long-term prediction filter 628 which uses the quantized long-term prediction coefficients $b_i$ to create a long-term prediction signal $p_{long}(n)$, according to the formula:

$$p_{long}(n) = \sum_{i=-2}^{2} e_{LPC}(n-\text{lag}-i)b(i).$$

The short-term and long-term prediction signals are added together at the fourth addition stage 626 to create the prediction filter output signal.

The LSF indices, LTP indices, quantization gains indices, pitch lags and excitation quantization indices would each be arithmetically encoded and multiplexed by the arithmetic encoder 518 to create the payload bitstream.

Figure 6B:
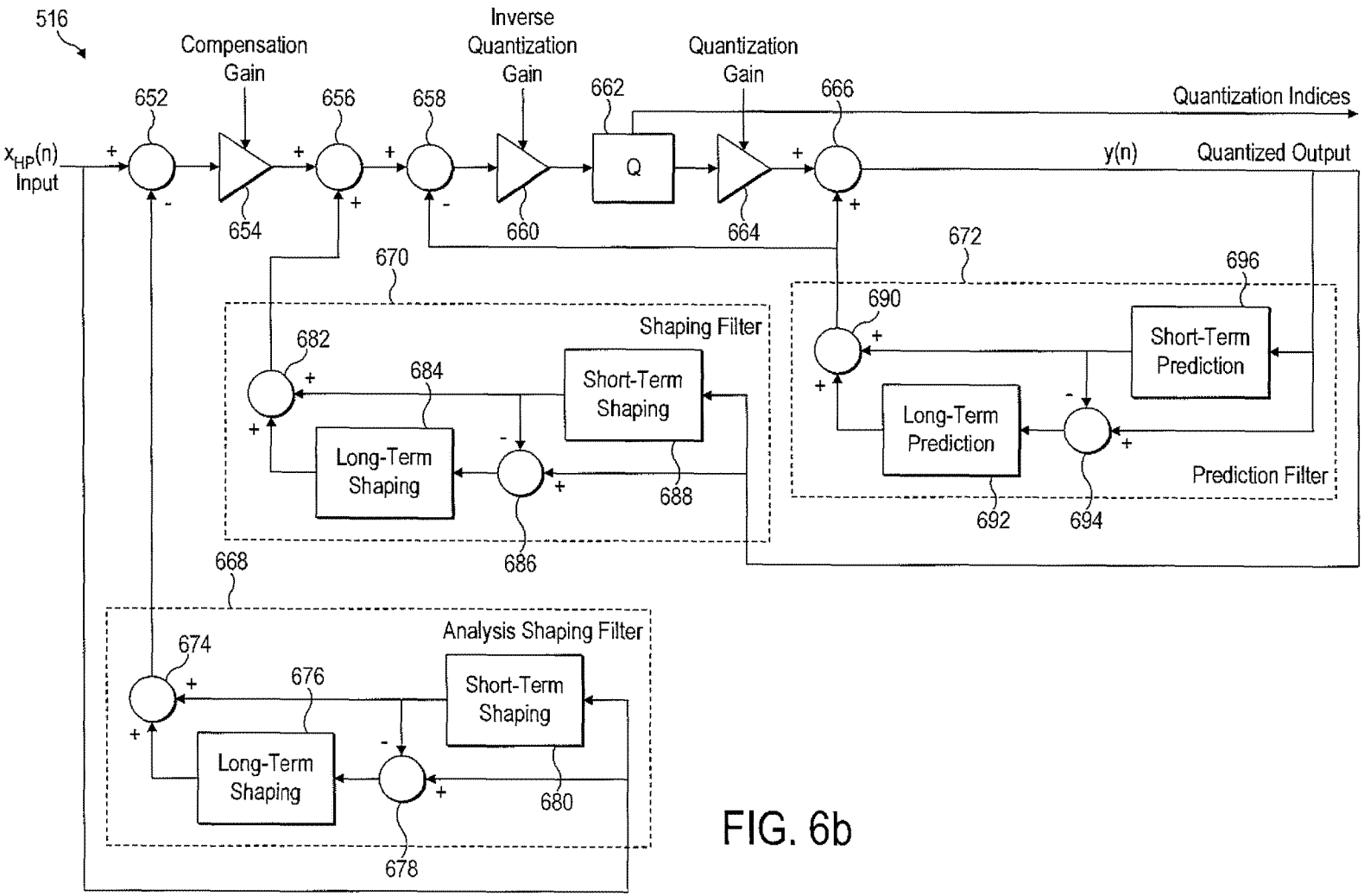
FIG. 6*b* is another schematic diagram of a noise shaping predictive quantizer.

As an illustration of one embodiment, a noise shaping predictive quantizer 516 having separate noise shaping filters at the input and output is now described in relation to FIG. 6*b*.

The noise shaping quantizer 516 comprises: a first subtraction stage 652, a first amplifier 654, a first addition stage 656, a second subtraction stage 658, a second amplifier 660, a quantization unit 662, a third amplifier 664, a second addition stage 666, a first noise shaping filter in the form of an analysis shaping filter 668, a second noise shaping filter in the form of a synthesis shaping filter 670, and a prediction filter 672. The analysis shaping filter 668 comprises a third addition stage 674, a first long-term shaping block 676, a third subtraction stage 678, and a first short-term shaping block 680. The synthesis shaping filter 670 comprises a fourth addition stage 682, a second long-term shaping block 684, a fourth subtraction stage 686, and a second short-term shaping block 688. The prediction filter 672 comprises a fifth addition stage 690, a long-term prediction block 692, a fifth subtraction stage 694, and a short-term prediction block 696.

The first subtraction stage 652 has an input arranged to receive the high-pass filtered input signal $x_{HP}(n)$ from the high-pass filter 502. Its other input is coupled to the output of the third addition stage 674 in the analysis shaping filter 668. The output of the first subtraction stage 652 is coupled to a signal input of the first amplifier 654. The first amplifier also has a control input coupled to the noise shaping analysis block 514. The output of the first amplifier 654 is coupled to an input of the first addition stage 656. The other input of the first addition stage 656 is coupled to the output of the fourth addition stage 682 in the synthesis shaping filter 670. The output of the first addition stage 656 is coupled to an input of the second subtraction stage 658. The other input of the second subtraction stage 658 is coupled to the output of the fifth addition stage 690 in the prediction filter 672. The output of the second subtraction stage 658 is coupled to a signal input of the second amplifier 660. The second amplifier 660 also has a control input coupled to the noise shaping analysis block 514. The output of the second amplifier 660 is coupled to the input of the quantization unit 662. The quantization unit 662 has an output coupled to a signal input of the third amplifier 664 and also has an output coupled to the arithmetic encoding block 518. The third amplifier 664 also has a control input coupled to the noise shaping analysis block 514. The output of the third amplifier 664 is coupled to an input of the second addition stage 666. The other input of the second addition stage 666 is coupled to the output of the fifth addition stage 690 in the prediction filter 672. The output of the second addition stage 666 is coupled to the inputs of the short-term prediction block 696 and fifth subtraction stage 694 in the prediction filter 672, and of the second short-term shaping filter 688 and fourth subtraction stage 686 in the synthesis shaping filter 670. The signal output from the second addition stage 666 is the quantized output y(n) fed back to the analysis, synthesis and prediction filters.

In the analysis shaping filter 668, the first short-term shaping block 680 and third subtraction stage 678 each have inputs arranged to receive the input signal $x_{HP}(n)$. The output of the first short-term shaping block 680 is coupled to the other input of the third subtraction stage 678 and an input of the third addition stage 674. The output of the third subtraction stage 678 is coupled to the input of the first long-term shaping block 676, and the output of the first short-term shaping block 676 is coupled to the other input of the third addition stage 674. The first short-term and long-term shaping blocks 680 and 676 are each also coupled to the noise shaping analysis block 514, and the first long-term shaping block 676 is further coupled to the open-loop pitch analysis block 508 (connections not shown). In the synthesis shaping filter 670, the second short-term shaping block 688 and the fourth subtraction stage 686 each have inputs arranged to receive the quantized output signal y(n) from the output of the second addition stage 666.

The output of the second short-term shaping block 688 is coupled to the other input of the fourth subtraction stage 686, and to an input of the fourth addition stage 682. The output of the fourth subtraction stage 686 is coupled to the input of the second long-term shaping block 684, and the output of the second long-term shaping block 684 is coupled to the other input of the fourth addition stage 682. The second short-term and long-term shaping blocks 688 and 684 are each also coupled to the noise shaping analysis block 514, and the second long-term shaping block 684 is further coupled to the open-loop pitch analysis block 508 (connections not shown). In the prediction filter 672, the short-term prediction block 696 and fifth subtraction stage 694 each have inputs arranged to receive the quantized output signal y(n) from the output of the second addition stage 666. The output of the short-term prediction block 696 is coupled to the other input of the fifth subtraction stage 694, and to an input of the fifth addition stage 690. The output of the fifth subtraction stage 694 is coupled to the input of the long-term prediction block 692, and the output of the long-term prediction block is coupled to the other input of the fifth addition stage 690.

In operation, the noise shaping quantizer 516 generates a quantized output signal y(n) that is identical to the output signal ultimately generated in the decoder. The output of the analysis shaping filter 668 is subtracted from the input signal x(n) at the first subtraction stage 652. At the first amplifier 654, the result is multiplied by the compensation gain G computed in the noise shaping analysis block 514. Then the output of the synthesis shaping filter 670 is added at the first addition stage 656, and the output of the prediction filter 672 is subtracted at the second subtraction stage 658 to create a residual signal. At the second amplifier 660, the residual signal is multiplied by the inverse quantized quantization gain from the noise shaping analysis block 514, and input to the quantization unit 662, in one or more embodiments, a scalar quantizer. The quantization indices of the quantization unit form a signal that is input to the arithmetic encoder 518 for transmission to a decoder in an encoded signal. The quantization unit 662 also outputs a quantization signal, which is multiplied at the third amplifier 664 by the quantized quantization gain from the noise shaping analysis block 514 to create an excitation signal. The output of the prediction filter 672 is added to the excitation signal to form the quantized output signal y(n). The quantized output signal is fed back to the prediction filter 672 and synthesis shaping filter 670.

The analysis shaping filter 668 inputs the input signal $x_{HP}(n)$ to a short-term analysis shaping filter (the first short term shaping block 680), which uses the short-term analysis shaping coefficients $a_{shape,ana}$ to create a short-term analysis shaping signal $s_{short,ana}(n)$, according to the formula:

$$s_{short,ana}(n) = \sum_{i=1}^{16} x_{HP}(n-i)a_{shape,ana}(i).$$

The short-term analysis shaping signal is subtracted from the input signal $x_{HP}(n)$ at the third subtraction stage 678 to create an analysis shaping residual signal $f_{ana}(n)$. The analysis shaping residual signal is input to a long-term analysis shaping filter (the first long-term shaping block 676) which uses the long-term shaping coefficients $b_{shape,ana}$ to create a long-term analysis shaping signal $s_{long,ana}(n)$, according to the formula:

$$s_{long,ana}(n) = \sum_{i=-2}^{2} f_{ana}(n-\text{lag}-i)b_{shape,ana}(i).$$

The short-term and long-term analysis shaping signals are added together at the third addition stage 674 to create the analysis shaping filter output signal.

The synthesis shaping filter inputs 670 the quantized output signal y(n) to a short-term shaping filter (the second short-term shaping block 688), which uses the short-term synthesis shaping coefficients $a_{shape,syn}$ to create a short-term synthesis shaping signal $s_{short,syn}(n)$, according to the formula:

$$s_{short,syn}(n) = \sum_{i=1}^{16} y(n-i)a_{shape,syn}(i).$$

The short-term synthesis shaping signal is subtracted from the quantized output signal y(n) at the fourth subtraction stage 686 to create an synthesis shaping residual signal $f_{syn}(n)$. The synthesis shaping residual signal is input to a long-term synthesis shaping filter (the second long-term shaping block 684) which uses the long-term shaping coefficients $b_{shape,syn}$ to create a long-term synthesis shaping signal $s_{long,syn}(n)$, according to the formula:

$$s_{long,syn}(n) = \sum_{i=-2}^{2} f_{syn}(n-\text{lag}-i)b_{shape,syn}(i).$$

The short-term and long-term synthesis shaping signals are added together at the fourth addition stage 682 to create the synthesis shaping filter output signal.

The prediction filter 672 inputs the quantized output signal y(n) to a short-term predictor (the short term prediction block 696), which uses the quantized LPC coefficients $a_Q$ to create a short-term prediction signal $p_{short}(n)$, according to the formula:

$$p_{short}(n) = \sum_{i=1}^{16} y(n-i)a_Q(i).$$

The short-term prediction signal is subtracted from the quantized output signal y(n) at the fifth subtraction stage 694 to create an LPC excitation signal $e_{LPC}(n)$:

$$e_{LPC}(n) = y(n) - p_{short}(n) = y(n) - \sum_{i=1}^{16} y(n-i)a_Q(i).$$

The LPC excitation signal is input to a long-term predictor (long term prediction block 692) which uses the quantized long-term prediction coefficients $b_Q$ to create a long-term prediction signal $p_{long}(n)$, according to the formula:

$$p_{long}(n) = \sum_{i=-2}^{2} e_{LPC}(n - \text{lag} - i)b_Q(i).$$

The short-term and long-term prediction signals are added together at the fifth addition stage 690 to create the prediction filter output signal.

The LSF indices, LTP indices, quantization gains indices, pitch lags, and excitation quantization indices are each arithmetically encoded and multiplexed by the arithmetic encoder 518 to create the payload bitstream. The arithmetic encoder 518 uses a look-up table with probability values for each index. The look-up tables are created by running a database of speech training signals and measuring frequencies of each of the index values. The frequencies are translated into probabilities through a normalization step.

Figure 7A:
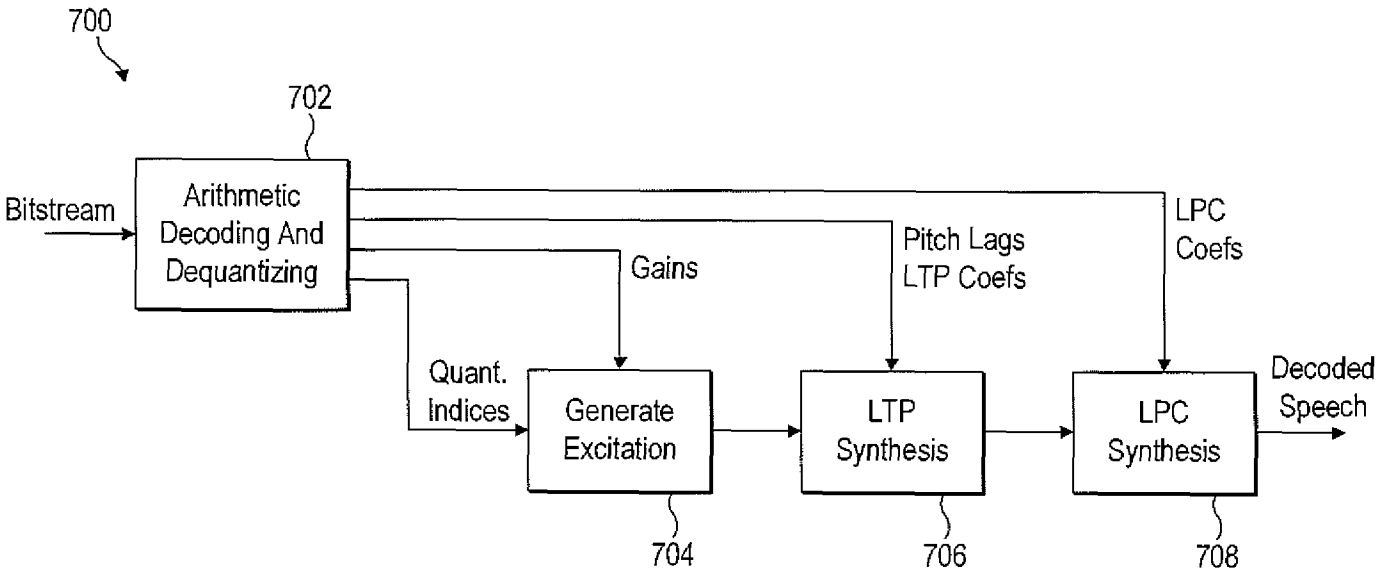
FIG. 7*a* is another schematic diagram of a decoder.
Figure 7B:
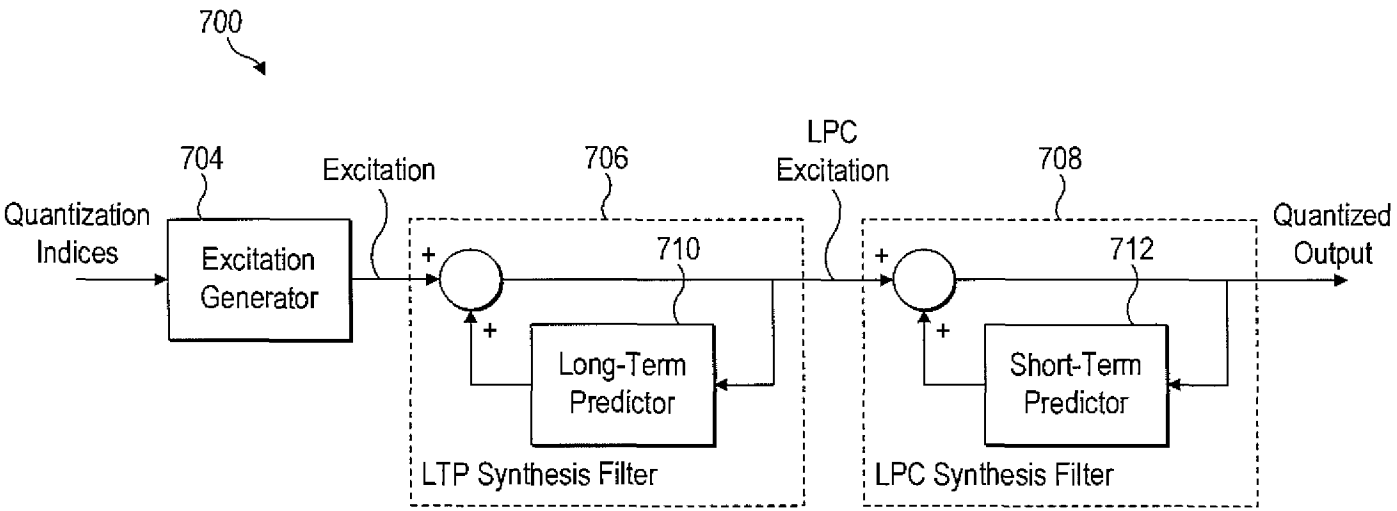
FIG. 7*b* shows more detail of the decoder of FIG. 7*a*.

A predictive speech decoder 700 for use in decoding such a signal is now discussed in relation to FIGS. 7*a* and 7*b*.

The decoder 700 comprises an arithmetic decoding and dequantizing block 702, an excitation generation block 704, an LTP synthesis filter 706, and an LPC synthesis filter 708. The arithmetic decoding and dequantizing block has an input arranged to receive an encoded bitstream from an input device such as a wired modem or wireless transceiver, and has outputs coupled to inputs of each of the excitation generation block 704, LTP synthesis filter 706 and LPC synthesis filter 708. The excitation generation block 704 has an output coupled to an input of the LTP synthesis filter 706, and the LTP synthesis filter 706 has an output connected to an input of the LPC synthesis filter 708. The LPC synthesis filter has an output arranged to provide a decoded output for supply to an output device such as a speaker or headphones.

At the arithmetic decoding and dequantizing block 702, the arithmetically encoded bitstream is demultiplexed and decoded to create LSF indices, LTP indices, quantization gains indices, pitch lags and a signal of excitation quantization indices. The LSF indices are converted to quantized LSFs by adding the codebook vectors of the ten stages of the MSVQ. The quantized LSFs are transformed to quantized LPC coefficients. The LTP indices are converted to quantized LTP coefficients. The gains indices are converted to quantization gains, through look ups in the gain quantization codebook.

The quantization indices are input to the excitation generator 704 which generates an excitation signal. The excitation quantization indices are multiplied with the quantized quantization gain to produce the excitation signal e(n).

The excitation signal e(n) is input to the LTP synthesis filter 706 to create the LPC excitation signal $e_{LPC}(n)$. Here, the output of a long term predictor 710 in the LTP synthesis filter 708 is added to the excitation signal, which creates the LPC excitation signal $e_{LPC}(n)$ according to:

$$e_{LPC}(n) = e(n) + \sum_{i=-2}^{2} e(n - \text{lag} - i)b_Q(i),$$

using the pitch lag and quantized LTP coefficients $b_Q$.

The LPC excitation signal is input to the LPC synthesis filter 708, in one or more embodiments, a strictly causal MA filter controlled by the pitch lag and quantized LTP coefficients, to create the decoded speech signal y(n). Here, the output of a short term predictor 712 in the LPC synthesis filter 708 is added to the LPC excitation signal, which creates the quantized output signal according to:

$$y(n) = e_{LPC}(n) + \sum_{i=1}^{16} e_{LPC}(n-i)a_Q(i),$$

using the quantized LPC coefficients $a_Q$.

The encoder 500 and decoder 700 are, in one or more embodiments, implemented in software, such that each of the components 502 to 518, 652 to 696, and 702 to 712 comprise modules of software stored on one or more memory devices and executed on a processor. An example application of the described embodiments is to encode speech for transmission over a packet-based network such as the Internet, using a peer-to-peer (P2P) system implemented over the Internet, for example as part of a live call such as a Voice over IP (VoIP) call. In this case, the encoder 500 and decoder 700 are, in one or more embodiments, implemented in client application software executed on end-user terminals of two users communicating over the P2P system.

It will be appreciated that the above embodiments are described only by way of example. For instance, some or all of the modules of the encoder and/or decoder could be implemented in dedicated hardware units. Further, the various embodiments are not limited to use in a client application, but could be used for any other speech-related purpose such as cellular mobile telephony. Further, instead of a user input device like a microphone, the input speech signal could be received by the encoder from some other source such as a storage device and potentially be transcoded from some other form by the encoder; and/or instead of a user output device such as a speaker or headphones, the output signal from the decoder could be sent to another source such as a storage device and potentially be transcoded into some other form by the decoder. Other applications and configurations may be apparent to the person skilled in the art given the disclosure herein.

What is claimed is:

1. A device to digitally encode an audio input speech signal by independently manipulating a signal spectrum and a coding noise spectrum associated with the audio input speech signal the device implemented, at least in part, in hardware, and comprising:

an input path configured to receive the audio input speech signal from a microphone;

a high pass filter configured to generate a filtered speech signal from the audio input speech signal;

a Linear Predictive Coding (LPC) analysis module configured to:

receive the filtered speech signal;

generate a first LPC analysis output based upon the filtered speech signal; and generate a second LPC analysis output based upon the filtered speech signal;

a noise shaping analysis module configured to:

receive the filtered speech signal; and generate a noise shaping output based, at least in part, on the filtered speech signal;

a noise shaping quantizer module for generating at least portions of a digital representation of the audio input speech signal the noise shaping quantizer module configured to:

receive the filtered speech signal as a first input;

receive a second input including first and second sets of noise shaping coefficients based, at least in part, on the noise shaping output;

receive a third input including a first set of prediction coefficients based, at least in part, on the first LPC analysis output;

receive a fourth input including a second set of prediction coefficients based, at least in part, on the second LPC analysis output; and generate the at least portions of the digital representation by using the first input, second input, third input, and fourth input to:

supply the first input and the first set of prediction coefficients to a first instance of a prediction filter effective to generate a first predicted signal;

subtract the first predicted signal from the first input effective-to generate a modified input signal;

supply the modified input signal and a subtraction stage output signal to an addition stage effective-to generate a first addition stage output signal, the subtraction stage output signal to the addition stage comprising:

a first filtered signal subtracted from a second filtered signal, the first filtered signal comprising the first addition stage output signal filtered with a first noise shaping filter comprising the first set of noise-shaping filter coefficients, the second filtered signal comprising a quantized version of the first addition stage output signal filtered with a second noise shaping filter comprising the second set of noise shaping filter coefficients;

quantize the first addition stage output signal;

generate one or more quantization indices used in the digital representation of the audio input speech signal based upon the quantized first addition state output signal; and generate an output signal of the noise shaping quantizer module used in the digital representation of the audio input speech signal by supplying the quantized first addition stage signal and a third filtered signal to a second addition stage, the third filtered signal comprising the output signal filtered with a second instance of the prediction filter comprising the second set of prediction coefficients; and an encoding module configured to combine the noise shaping output, the first and second LPC analysis outputs and the output signal of the noise shaping quantizer module to generate a bitstream configured to be decoded by a decoder to reproduce the audio input speech signal, wherein the noise shaping quantizer module is further configured to generate the noise shaping output by independently manipulating the signal spectrum and the coding noise spectrum associated with the audio input speech signal.

2. The device of claim 1, wherein the second input is based, at least in part, on the noise shaping output and comprises one or more quantization gains.

3. The device of claim 1, wherein the third input comprises one or more pitch lags generated from an open-loop pitch analysis module, the one or more pitch lags based, at least in part, on the first LPC analysis output.

4. The device of claim 1, wherein the fourth input comprises one or more quantized LPC coefficients based, at least in part, on the second LPC analysis output, the one or more quantized LPC coefficients based on the second LPC analysis output being generated using a line spectral frequency (LSF) vector.

5. The device of claim 1 wherein the noise shaping quantizer is further configured to receive a fifth input comprising one or more quantized LPC coefficients based, at least in part, on the first LPC analysis output, the one or more quantized LPC coefficients based on the first LPC analysis output being generated using a line spectral frequency (LSF) vector.

6. The device of claim 1, wherein the noise shaping quantizer is further configured to update at least one of the first and second filter coefficients based on at least one property of the first input.

7. The device of claim 3, wherein the at least one property comprises at least one of:

a signal spectrum associated with the first input; or a noise spectrum associated with the first input.

8. A device to digitally encode an audio input speech signal by independently manipulating a signal spectrum and a coding noise spectrum associated with the audio input speech signal, the device implemented, at least in part, in hardware, and comprising:

an input path configured to receive the audio input speech signal from a microphone;

a high pass filter configured to generate a filtered speech signal from the audio input speech signal;

a Linear Predictive Coding (LPC) analysis module configured to:

receive the filtered speech signal;

generate a first LPC analysis output based upon the filtered speech signal; and generate a second LPC analysis output based upon the filtered speech signal;

a noise shaping analysis module configured to:

receive the filtered speech signal; and generate a noise shaping output based, at least in part, on the filtered speech signal;

a noise shaping quantizer module for generating at least portions of a digital representation of the audio input speech signal the noise shaping quantizer module configured to:

receive the filtered speech signal as a first input;

receive a second input including first and second sets of noise shaping coefficients based, at least in part, on the noise shaping output;

receive a third input including first prediction coefficients based, at least in part, on the first LPC analysis output;

receive a fourth input including second prediction coefficients based, at least in part, on the second LPC analysis output; and generate the at least portions of the digital representation of the audio input speech signal by using the first input, second input, third input, and fourth input to:

supply the first input to a first weighting filter with a first set of weighting filter coefficients effective to generate a first filtered signal;

supply the first filtered signal and a second filtered signal to a subtraction stage effective to generate a first subtraction stage signal;

supply the first subtraction stage signal to an energy minimizing device effective to control a quantization unit, the quantization unit configured to output a quantized intermediate-output signal; and generate an output signal used in the digital representation of the audio input speech signal by supplying the quantized intermediate-output signal and a third filtered signal to an addition stage, and an encoding module configured to combine the noise shaping output, the first and second LPC analysis outputs and the at least portions of the digital representation of the audio input speech signal to generate a bitstream configured to be decoded by a decoder to reproduce the audio input speech signal, wherein the third filtered signal comprises the output signal used in the digital representation of the audio input speech signal filtered with a prediction filter having a second set of prediction filter coefficients and the second filtered signal comprises the output signal used in the digital representation of the audio input speech signal filtered with a second weighted filter having a third set of filter coefficients, and wherein the noise shaping quantizer module is further configured to generate the output signal by independently manipulating the signal spectrum and the coding noise spectrum.

9. The device of claim 8, wherein the second input is based, at least in part, on the noise shaping output and comprises one or more quantization gains.

10. The device of claim 8, wherein the third input comprises one or more pitch lags generated from an open-loop pitch analysis module, the one or more pitch lags based, at least in part, on the first LPC analysis output.

11. The device of claim 8, wherein the fourth input comprises one or more quantized LPC coefficients based, at least in part, on the second LPC analysis output, the one or more quantized LPC coefficients based on the second LPC analysis output being generated using a line spectral frequency (LSF) vector.

12. The device of claim 8 wherein the noise shaping quantizer is further configured to receive a fifth input comprising one or more quantized LPC coefficients based, at least in part, on the first LPC analysis output, the one or more quantized LPC coefficients based on the first LPC analysis output being generated using a line spectral frequency (LSF) vector.

13. The device of claim 8, wherein:

the quantization unit is further configured to generate a plurality of possible versions of the intermediate output signal; and the addition stage is configured to add each one of the plurality of possible versions of the intermediate output signal with the third filtered signal.

14. A device to digitally encode an audio input speech signal by independently manipulating a signal spectrum and a coding noise spectrum associated with the audio input speech signal, the device implemented, at least in part, in hardware, and comprising:

an input path configured to receive the audio input speech signal from a microphone;

a high pass filter configured to generate a filtered speech signal from the audio input speech signal;

a Linear Predictive Coding (LPC) analysis module configured to:

receive the filtered speech signal;

generate a first LPC analysis output based upon the filtered speech signal; and generate a second LPC analysis output based upon the filtered speech signal;

a noise shaping analysis module configured to:

receive the filtered speech signal; and generate a noise shaping output based, at least in part, on the filtered speech signal;

a noise shaping quantizer module for generating at least portions of a digital representation of the audio input speech signal, the noise shaping quantizer module configured to:

receive the filtered output speech signal as a first input;

receive a second input including first and second sets of noise shaping coefficients based, at least in part, on the noise shaping output;

receive a third input including first prediction coefficients based, at least in part, on the first LPC analysis output;

receive a fourth input including second prediction coefficients based, at least in part, on the second LPC analysis output; and, generate the at least portions of the digital representation of the audio input speech signal by using the first input, second input, third input, and fourth input to:

generate a quantized output signal used in the digital representation of the audio input speech signal by quantizing the first input;

prior to said generating the quantized output signal, supply a version of the first input to a first noise shaping filter having the first set of noise shaping filter coefficients effective to generate a first filtered signal based on that version of the first input and the first set of noise shaping filter coefficients;

following said generating the quantized output signal, supply a version of the quantized output signal to a second noise shaping filter having the second set of noise shaping filter coefficients different than said first set of noise shaping filter coefficients and effective to generate a second filtered signal based on that version of the output signal and the second set of noise shaping filter coefficients; and control a frequency spectrum of a noise effect in the quantized output signal caused by said quantization by performing a noise shaping operation based on the first filtered signal and the second filtered signal, and an encoding module configured to combine the noise shaping output, the first and second LPC analysis outputs and the at least portions of the digital representation of the audio input speech signal to generate a bitstream configured to be decoded by a decoder to reproduce the audio input speech signal, wherein the noise shaping operation comprises independent manipulation of the signal spectrum and the coding noise spectrum, via the first filtered signal and the second filtered signal, to improve an encoding efficiency associated with generating the digital representation relative to an encoding efficiency associated with dependent manipulation of the signal spectrum and the coding noise spectrum.

15. The device of claim 14, wherein the noise shaping quantizer is further configured to:

subtract the output of a prediction filter from the first input prior to said quantization, and add the output of a prediction filter to the quantized output signal following said quantization.

16. The device of claim 14, wherein the second input is based, at least in part, on the noise shaping output and comprises one or more quantization gains.

17. The device of claim 14, wherein the third input comprises one or more pitch lags generated from an open-loop pitch analysis module, the one or more pitch lags based, at least in part, on the first LPC analysis output.

18. The device of claim 14, wherein the fourth input comprises one or more quantized LPC coefficients based, at least in part, on the second LPC analysis output, the one or more quantized LPC coefficients based on the second LPC analysis output being generated using a line spectral frequency (LSF) vector.

19. The device of claim 14 wherein the noise shaping quantizer is further configured to receive a fifth input comprising one or more quantized LPC coefficients based, at least in part, on the first LPC analysis output, the one or more quantized LPC coefficients based on the first LPC analysis output being generated using a line spectral frequency (LSF) vector.

20. The device of claim 1, the output signal further comprising a quantized output signal configured to enable a decoder to reconstruct a synthesized version of the audio input speech signal using the quantized output signal and the one or more quantization indices.

21. The device of claim 1, wherein:

the bitstream generated by the encoding module has an improved encoding efficiency relative to a digital representation of the input audio speech signal generated by dependent manipulation of the signal spectrum and the coding noise spectrum.

22. The device of claim 1, wherein the manipulating further comprises updating the first set of prediction coefficients or the second set of prediction coefficients based, at least in part, on changes in one or more speech properties in the audio input speech signal over time.

* * * * *